US007320636B2

(12) United States Patent
Seliger et al.

(10) Patent No.: US 7,320,636 B2
(45) Date of Patent: Jan. 22, 2008

(54) EXHAUST FAN ASSEMBLY HAVING FLEXIBLE COUPLING

(75) Inventors: Michael Glenn Seliger, Marathon, WI (US); Terry Lee Hrdina, Wausau, WI (US); Scott James Koeppel, Wausau, WI (US)

(73) Assignee: Greenheck Fan Corporation, Schofield, WI (US)

( * ) Notice: Subject to any disclaimer, the term of this patent is extended or adjusted under 35 U.S.C. 154(b) by 0 days.

(21) Appl. No.: 11/003,257

(22) Filed: Dec. 3, 2004

(65) Prior Publication Data

US 2005/0159102 A1 Jul. 21, 2005

Related U.S. Application Data

(63) Continuation-in-part of application No. 10/924,532, filed on Aug. 24, 2004.

(60) Provisional application No. 60/588,074, filed on Mar. 30, 2004, provisional application No. 60/537,609, filed on Jan. 20, 2004.

(51) Int. Cl.
*B05B 15/12* (2006.01)

(52) U.S. Cl. ..... 454/63; 454/67; 126/299 F

(58) Field of Classification Search ..... 454/61, 454/56, 59, 63, 65; 126/299 R, 299 D
See application file for complete search history.

(56) References Cited

U.S. PATENT DOCUMENTS

| | | | | |
|---|---|---|---|---|
| 144,586 | A | 11/1873 | Wingate | |
| 297,972 | A | 5/1884 | Day | |
| 352,597 | A | 11/1886 | Wohlfert | |
| 603,881 | A | 5/1898 | Kuphal | |
| 736,748 | A | 8/1903 | Le Beau | |
| 1,126,348 | A | 1/1915 | Basman | |
| 1,296,040 | A | 3/1919 | Bontya | |
| 1,346,633 | A | 7/1920 | Cloud | |
| 1,394,735 | A | 10/1921 | Jordan | |
| 1,891,860 | A | 12/1932 | Woolf | |
| 1,986,176 | A | 1/1935 | Zwerling | |
| 1,988,810 | A | 1/1935 | Ross | |
| 2,082,955 | A * | 6/1937 | Hagen | 416/188 |

(Continued)

FOREIGN PATENT DOCUMENTS

| | | |
|---|---|---|
| FR | 1.173.612 | 12/1959 |

(Continued)

OTHER PUBLICATIONS

TB Wood's, Flexible Couplings, Brochure.

*Primary Examiner*—Derek S. Boles
(74) *Attorney, Agent, or Firm*—Quarles & Brady LLP

(57) ABSTRACT

An exhaust assembly is provided for expelling contaminated air from a building. The assembly includes a plenum, a fan assembly attached to the plenum, and a windband mounted on top of the fan assembly. The fan assembly is constructed of cylindrical outer and inner walls which define a drive chamber and surrounding annular space. A fan driven by a motor whose shaft extends downward from the drive chamber draws exhaust air from the plenum and blows it up through the annular space to a nozzle at the top of the fan assembly. The motor is pivotally mounted inside the assembly to provide access to the motor components when it is desired to perform inspection and maintenance.

20 Claims, 18 Drawing Sheets

U.S. PATENT DOCUMENTS 2,188,564 A 1/1940 Berg
2,265,112 A 12/1941 Davies
2,363,733 A 11/1944 Karol
2,478,761 A 8/1949 Houseman
2,551,004 A * 5/1951 Johnson ..... 454/341
2,605,693 A 8/1952 Hansen
2,619,021 A 11/1952 Pfautsch
2,714,847 A 8/1955 Svebel
2,777,382 A * 1/1957 Solzman ..... 454/341
2,805,615 A * 9/1957 Rudy ..... 454/350
2,842,041 A 7/1958 Armin
2,875,678 A 3/1959 Wyley
3,045,579 A 7/1962 Jenn et al.
3,069,071 A 12/1962 Carlson
3,087,409 A 4/1963 Carr
3,115,820 A 12/1963 Adelt
3,122,088 A * 2/1964 Patterson ..... 454/341
3,194,305 A * 7/1965 Moore ..... 165/47
3,209,670 A 10/1965 Twickler
3,229,896 A * 1/1966 Levy ..... 417/423.8
3,283,694 A 11/1966 Dean, Jr.
3,285,567 A 11/1966 Richardson
3,313,228 A * 4/1967 Cook ..... 454/341
3,347,147 A 10/1967 Howard
3,382,792 A * 5/1968 Howard ..... 454/38
3,385,197 A 5/1968 Greber
3,390,401 A * 6/1968 Matsuyoshi et al. ..... 417/350
3,537,411 A 11/1970 Rov
3,719,032 A 3/1973 Cash
3,727,566 A 4/1973 Roy
3,730,073 A 5/1973 Potter
3,747,505 A * 7/1973 Turko ..... 454/59
3,797,373 A 3/1974 Larson
3,817,162 A 6/1974 Guelph
3,946,648 A * 3/1976 Schneider ..... 454/341
4,095,514 A 6/1978 Roy et al.
4,184,417 A 1/1980 Chancellor
4,204,463 A 5/1980 Carty
4,245,965 A * 1/1981 Brown ..... 417/360
4,344,370 A 8/1982 Smith et al.
4,437,868 A * 3/1984 Kuhlman ..... 62/411
4,472,110 A * 9/1984 Sun Keu ..... 416/170 R
4,494,450 A * 1/1985 Avril ..... 454/341
4,534,281 A * 8/1985 Parks et al. ..... 454/59
4,655,121 A 4/1987 Ludwig
4,742,765 A 5/1988 Weinert et al.
4,768,424 A * 9/1988 Frenkler et al. ..... 454/341
4,806,076 A 2/1989 Andrews
4,856,420 A * 8/1989 Poblete et al. ..... 454/59
4,922,766 A 5/1990 Ahn
4,993,314 A 2/1991 Braden et al.
5,079,464 A * 1/1992 King et al. ..... 310/89
5,232,152 A * 8/1993 Tsang ..... 236/44 A
5,326,317 A 7/1994 Ishizu et al.
5,439,349 A 8/1995 Kupferberg
5,447,468 A * 9/1995 Tener et al. ..... 454/58
5,556,331 A * 9/1996 Bastian ..... 454/56
5,645,483 A * 7/1997 Cushman ..... 454/353
5,669,811 A * 9/1997 Zaniewski ..... 454/16
5,697,838 A * 12/1997 Morris ..... 454/62
5,716,267 A * 2/1998 Hambleton et al. ..... 454/56
5,797,790 A * 8/1998 Rindoks et al. ..... 454/59
6,112,850 A 9/2000 Secrest et al.
6,230,723 B1 * 5/2001 Hixson ..... 135/16
6,278,248 B1 * 8/2001 Hong et al. ..... 318/254
6,302,779 B1 * 10/2001 Ryan et al. ..... 454/61
6,336,338 B1 * 1/2002 Koren ..... 62/262
6,428,408 B1 * 8/2002 Bell et al. ..... 454/56
6,431,974 B1 8/2002 Tetley et al.
6,461,233 B1 * 10/2002 Gilkison et al. ..... 454/57
6,582,292 B1 * 6/2003 Bastian ..... 454/59
6,659,857 B2 * 12/2003 Ryan et al. ..... 454/56
6,676,503 B2 1/2004 Hill et al.
6,814,661 B2 * 11/2004 Jardinier ..... 454/341
6,871,170 B2 * 3/2005 Ryan et al. ..... 703/9
2003/0114098 A1 6/2003 Hill et al.

FOREIGN PATENT DOCUMENTS

GB 507.787 6/1939
GB 610.153 10/1948

* cited by examiner

FIG. 3B
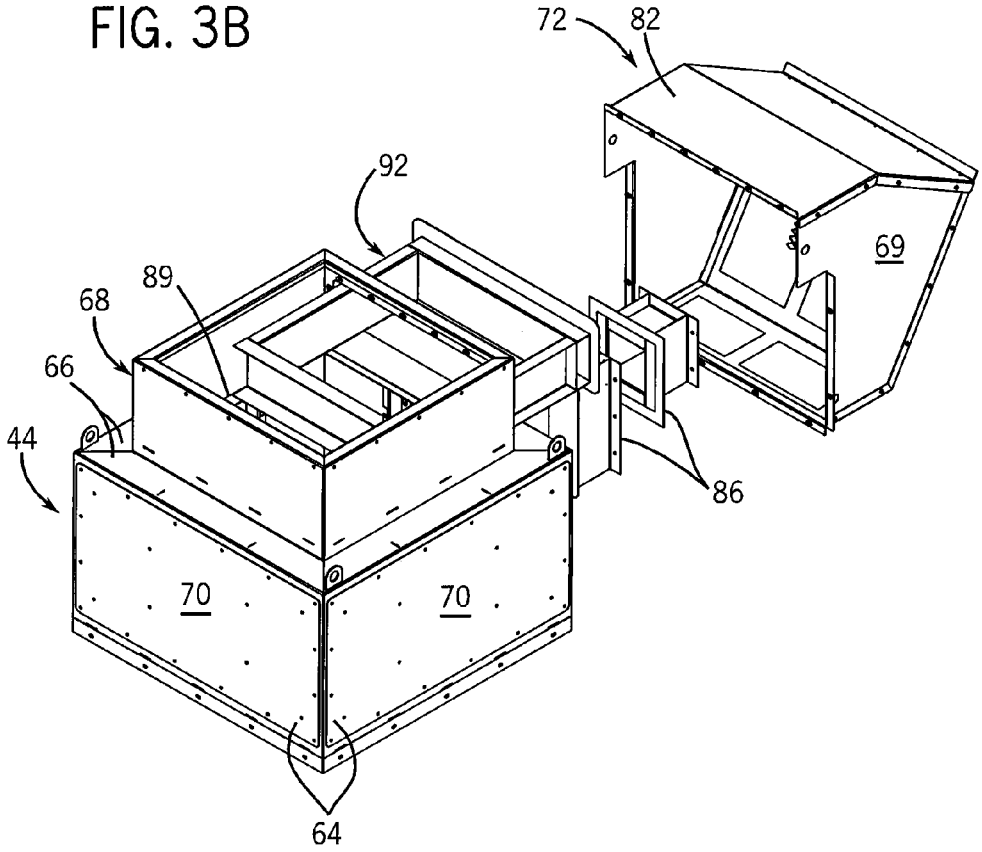
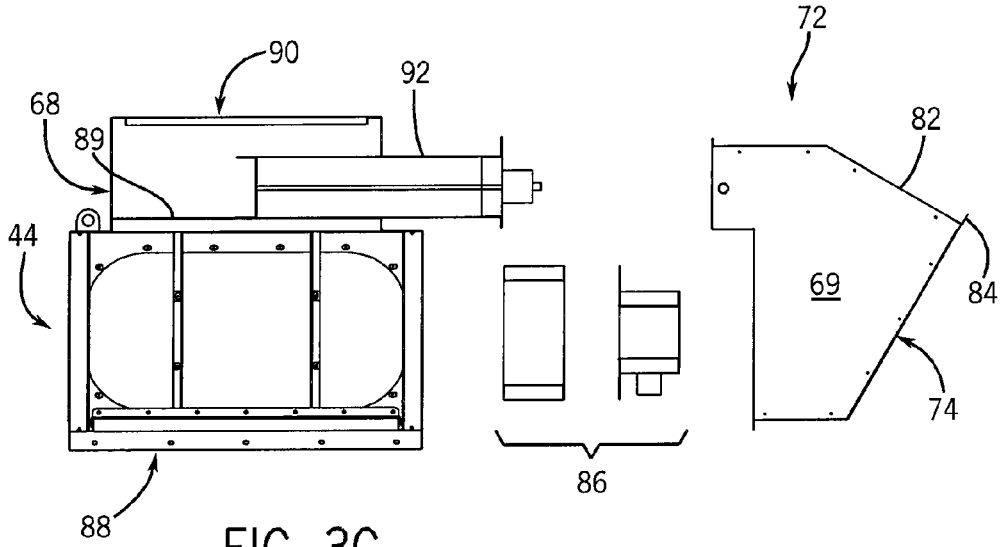
FIG. 3C

EXHAUST FAN ASSEMBLY HAVING FLEXIBLE COUPLING

CROSS REFERENCE TO RELATED APPLICATIONS

This is a continuation-in-part of U.S. patent application 10/924,532 filed Aug. 24, 2004, and further claims the benefit of U.S. Provisional Patent Application No. 60/537,609 filed Jan. 20, 2004, and further claims the benefit of U.S. Provisional Patent Application No. 60/558,074 filed Mar. 30, 2004, the disclosure of each of which is hereby incorporated by reference as if set forth in their entirety herein.

BACKGROUND OF THE INVENTION

The present invention relates generally to exhaust fans, and more particularly to exhaust fans of the type that draw contaminated air from one or more fume hoods dispersed throughout a building, mix the contaminated air with ambient air to dilute the contaminants, and vent the diluted air from the building into the ambient environment.

There are many different types of exhaust systems for buildings. In most of these the objective is to simply draw air from inside the building in an efficient manner. In building such as laboratories, fumes are produced by chemical and biological processes, which may have an unpleasant odor, is noxious or toxic. One solution is to exhaust such fumes through a tall exhaust stack which releases the fumes far above ground and roof level. Such exhaust stacks, however, are expensive to build and are unsightly.

Another solution is to mix the fumes with fresh air to dilute the contaminated air, and exhaust the diluted air upwards from the top of the building at a high velocity. The exhaust is thus diluted and blown high above the building. Examples of such systems are described in U.S. Pat. Nos. 4,806,076; 5,439,349 and 6,112,850.

Among these systems, U.S. Pat. No. 4,806,076 discloses a system in which a fan motor has a motor shaft that is directly connected to a fan having rotating fan blades that draw contaminated exhaust air from the building and blow the exhaust air up into the ambient environment. Unfortunately, the bearings that support the motor shaft inside the motor absorb the thrust loads imparted by the fan during operation, thus increasing wear on the motor. Furthermore, because the interface between the motor shaft and the fan is located in an area that receives exhaust air during operation, a person is required to enter an area that is polluted with contaminants when motor maintenance operations involve detachment of the motor shaft from the fan.

What is therefore desired is a building exhaust system including a building exhaust stack coupled to a fan that overcomes the deficiencies associated with conventional systems.

BRIEF SUMMARY OF THE INVENTION

In accordance with one aspect of the present invention, a fan assembly is configured to exhaust contaminated air from a building. The fan assembly includes an outer wall that defines a cavity therein having an air inlet formed at its bottom end. The air inlet receives the contaminated air. An inner wall is fastened to the outer wall and positioned in the cavity to divide it into a central chamber isolated from the contaminated air, and a surrounding annular space that receives the contaminated air. A fan is disposed in the central chamber, and is coupled to a fan shaft to draw exhaust air in through the air inlet and blow it upward through the annular space. A motor is mounted in the central chamber, and has a motor shaft that drives the fan shaft. A coupling is located in the central chamber and connects the fan shaft to the motor shaft.

In accordance with another aspect of the invention, an exhaust assembly is mounted onto a roof of a building for removing contaminated air from one or more building exhaust vents. The exhaust assembly includes an air inlet receiving the contaminated air, at least one ambient air entrainment zone mixing ambient air with the contaminated air to produce diluted air, and an air outlet exhausting the diluted air. A fan chamber retains a fan that is coupled to a fan shaft to draw exhaust air in through the air inlet and blow it in a direction toward the air outlet. A drive chamber is also provided. The drive chamber is isolated from the exhaust air, and retains a motor having a motor shaft operable to drive the fan shaft, and a coupling connecting the fan shaft to the motor shaft.

In accordance with still another aspect of the invention, an exhaust assembly is provided for expelling exhaust air from a building. The exhaust assembly includes a housing defining an inlet end receiving the exhaust air and an outlet end for expelling the exhaust air. The housing defines a fan chamber and a drive chamber that is isolated from the exhaust air. A fan is disposed in the fan chamber and coupled to a fan shaft for rotation to draw the exhaust air through the inlet and direct the exhaust air in a direction toward the outlet. A motor mounted in the drive chamber, the motor including a motor shaft coupled to the fan shaft via a coupling disposed in the drive chamber. At least one passageway extends through the housing, the passageway providing access to the motor and the coupling.

In the following description, reference is made to the accompanying drawings, which form a part hereof, and in which there is shown by way of illustration, and not limitation, a preferred embodiment of the invention. Such embodiment also does not define the scope of the invention and reference must therefore be made to the claims for this purpose.

BRIEF DESCRIPTION OF THE DRAWINGS

Reference is hereby made to the following drawings in which like reference numerals correspond to like elements throughout, and in which:

FIG. 3B is an exploded perspective view of the plenum of FIG. 3A;

FIG. 3C is an exploded side view of the plenum of FIG. 3A with parts removed;

DETAILED DESCRIPTION OF THE PREFERRED EMBODIMENT

Figure 1:
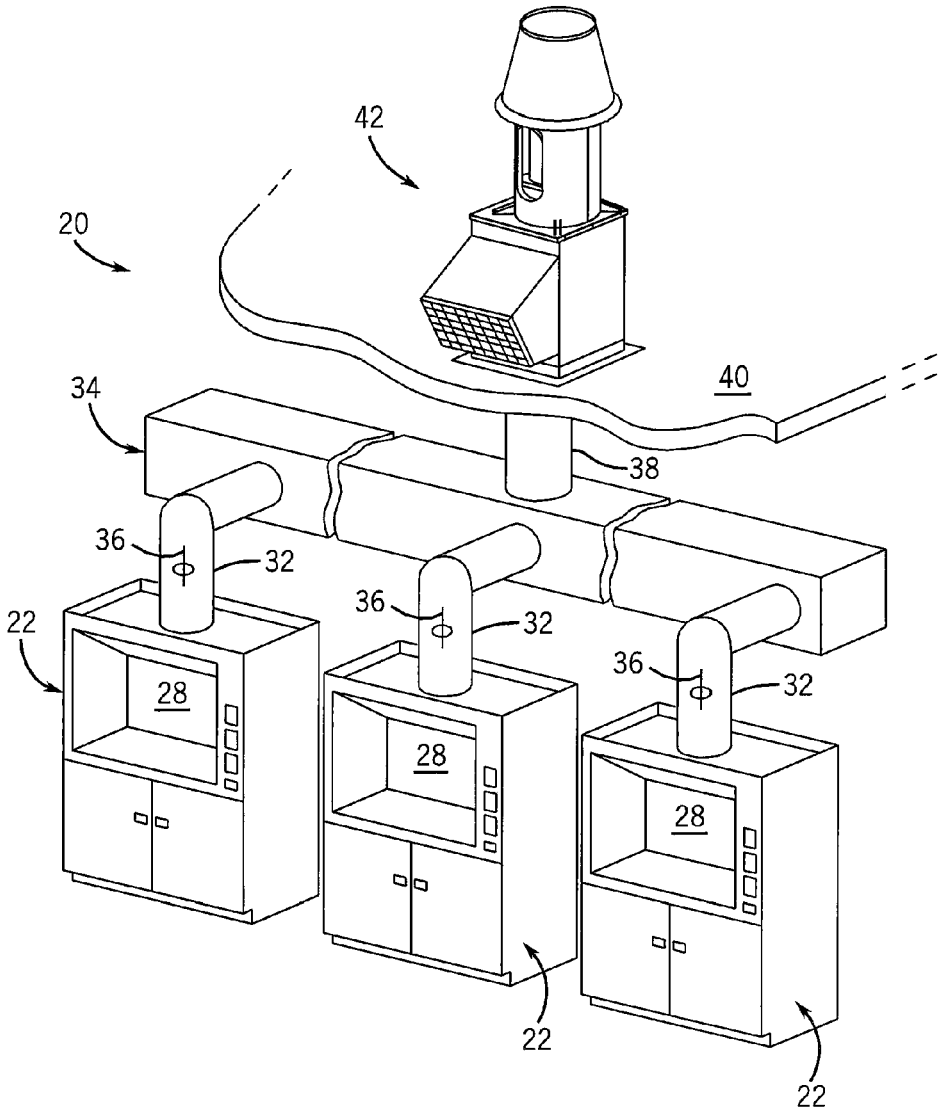
FIG. 1 is a schematic perspective view of a building ventilation system constructed in accordance with principles of the present invention.

Referring initially to FIG. 1, a building ventilation system 20 includes one or more fume hoods 22 of the type commonly installed in commercial kitchens, laboratories, manufacturing facilities, or other appropriate locations throughout a building that create noxious or other gasses that are to be vented from the building. In particular, each fume hood 22 defines a chamber 28 that is open at a front of the hood for receiving surrounding air. The upper end of chamber 28 is linked to the lower end of a conduit 32 that extends upwards from the hood 22 to a manifold 34. Manifold 34 is further connected to a riser 38 that extends upwards to a roof 40 or other upper surface of the building. The upper end of riser 38 is, in turn, connected to an exhaust assembly 42 that is mounted on top of roof 40 and extends upwards away from the roof for venting gasses from the building.

Figure 2:
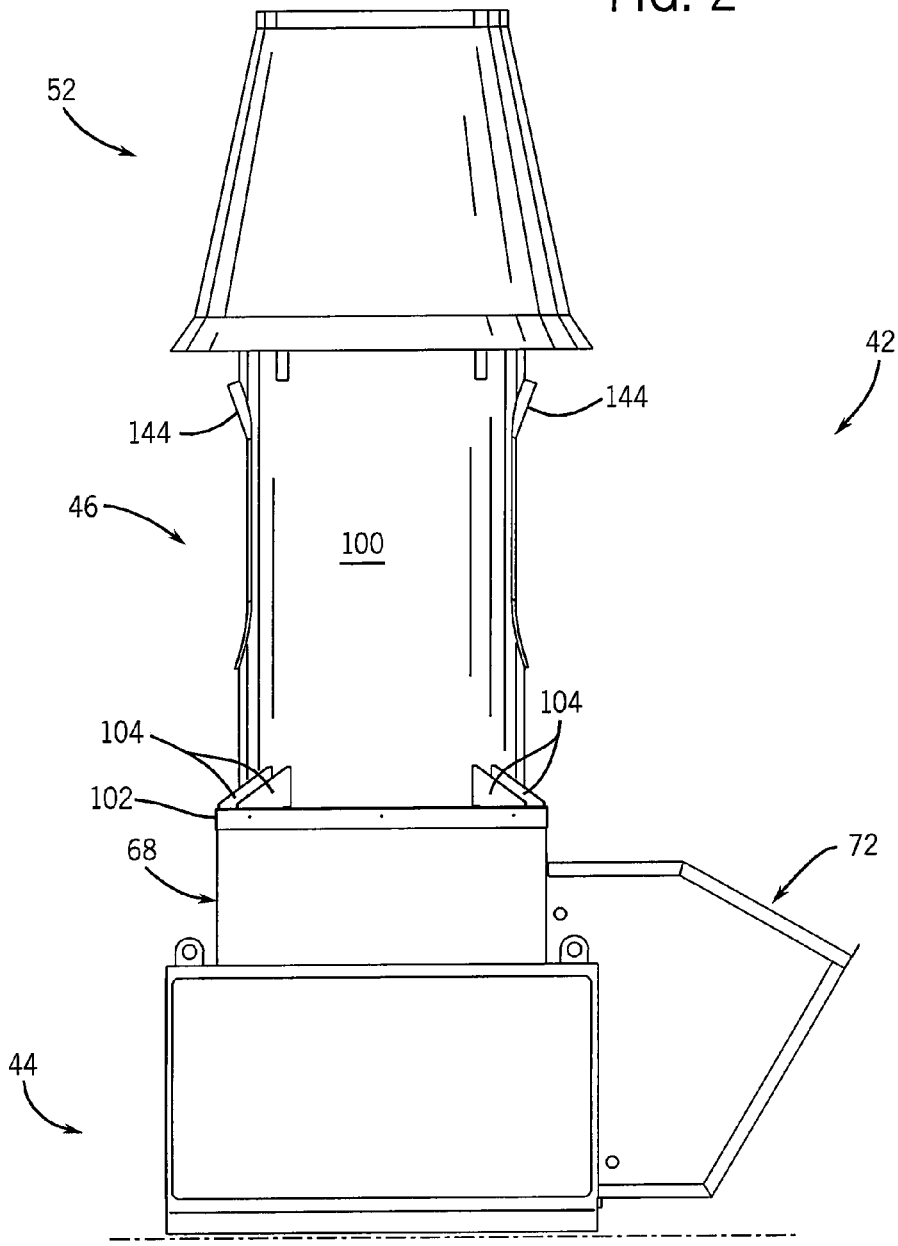
FIG. 2 is a side elevation view of an exhaust assembly constructed in accordance with the preferred embodiment.

Referring also to FIG. 2, exhaust assembly 42 includes a plenum 44 disposed at the base of the assembly that receives exhaust from riser 38 and mixes it with fresh air. A fan assembly 46 is connected to, and extends upwards from, plenum 44. Fan assembly 46 includes a fan wheel that draws exhaust upward through the plenum 44 and blows it out through a windband 52 disposed at its upper end. Each of these components is described in more detail below. During operation, exhaust assembly 42 draws an airflow that travels from each connected fume hood 22, through chamber 28, conduits 32, manifold 34, riser 38 and plenum 44. This exhaust air is mixed with fresh air before being expelled upward at high velocity through an opening in the top of the windband 52.

The control of this system typically includes both mechanical and electronic control elements. A conventional damper 36 is disposed in conduit 32 at a location slightly above each hood 22, and is automatically actuated between a fully open orientation (as illustrated) and a fully closed orientation to control exhaust flow through the chamber 28. Hence, the volume of air that is vented through each hood 22 is controlled.

The building can be equipped with more than one exhaust assembly 42, each such assembly 42 being operably coupled either to a separate group of fume hoods 22 or to manifold 34. Accordingly, each exhaust assembly 42 can be responsible for venting noxious gasses from a particular zone within the building 26, or a plurality of exhaust assemblies 42 can operate in tandem off the same manifold 34. In addition, the manifold 34 may be coupled to a general room exhaust in building 26. An electronic control system (not shown) may be used to automatically control the operation of the system.

Figure 3A:
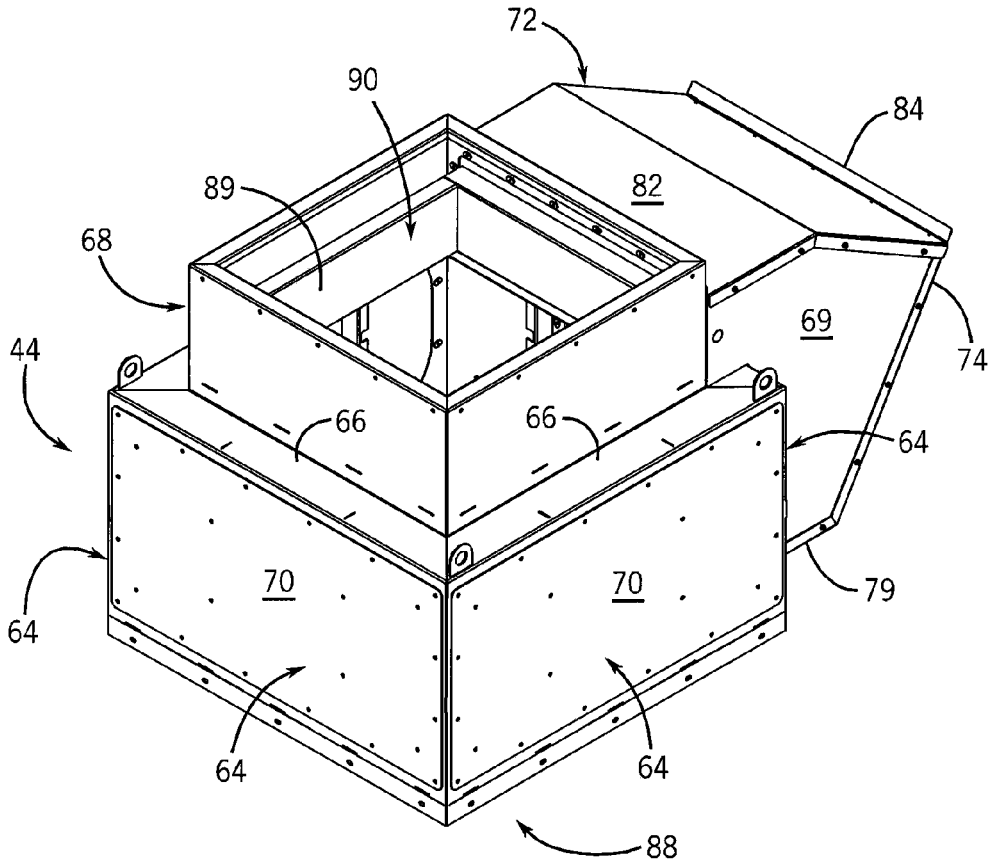
FIG. 3A is a perspective view of the plenum which forms part of the exhaust fan assembly of FIG. 2 with parts removed.

As shown best in FIGS. 3A, B and C, the plenum 44 includes a rectangular housing formed by four upright walls 64 and a top wall 66. A rectangular pedestal 68 is fastened to the top wall 66 and it serves as the support for the fan assembly 46 that removably fastens to it. All four walls 64 are constructed with identical panels 70 that can be selectively removed to orient the plenum 44 in any desired direction. When a panel 70 is removed, a large opening is formed in the plenum wall 64. A panel 70 is removed on one wall 64 to form the front to which a hood 72 is attached.

The hood 72 extends outwardly from the housing to provide a bypass air inlet 74 to the plenum 44. The hood 72 is formed by a pair of spaced vertical walls 69, a bottom wall 79, and a rain hood 82 which extends horizontally outward from the housing and then slopes downward. An upwardly-turned lip 84 is formed on the drip edge of the rain hood 82 to prevent water from dripping into the bypass air stream.

A damper 86 is mounted beneath the hood 72 to control the amount of ambient air that enters the plenum housing through the bypass air inlet 74. It includes damper blades that are controlled electronically or pneumatically to enable a flow of bypass air into the plenum 44 which maintains a constant total air flow into the fan assembly 46 despite changes in the volume of air exhausted from the building. Exhaust air from the building enters the plenum 44 through an exhaust inlet 88 formed in the bottom of the rectangular housing and mixes with the bypass air to produce once-diluted exhaust air that is drawn upward through an exhaust outlet 90 in the top of the pedestal 68 and into the fan assembly 46.

As shown best in FIGS. 3B and 3C, an isolation damper 92 is slidably mounted in the pedestal 68 just beneath the exhaust outlet 90. The isolation damper 92 is supported by a flange 89 formed around the interior of the pedestal 68, and it slides into place through the front wall of the pedestal. The isolation damper 92 serves to isolate the outdoor ambient air flowing downward through the fan assembly 46 when the fan is not operating. The isolation damper 92 has blades which are rotated by gravity, backdraft or a rotated shaft to close the damper when the fan is not operating. The isolation damper 92 may be easily removed for inspection or repair by disconnecting the hood 72 from the plenum 44 and sliding the damper 92 out of the pedestal 68.

Figure 4:
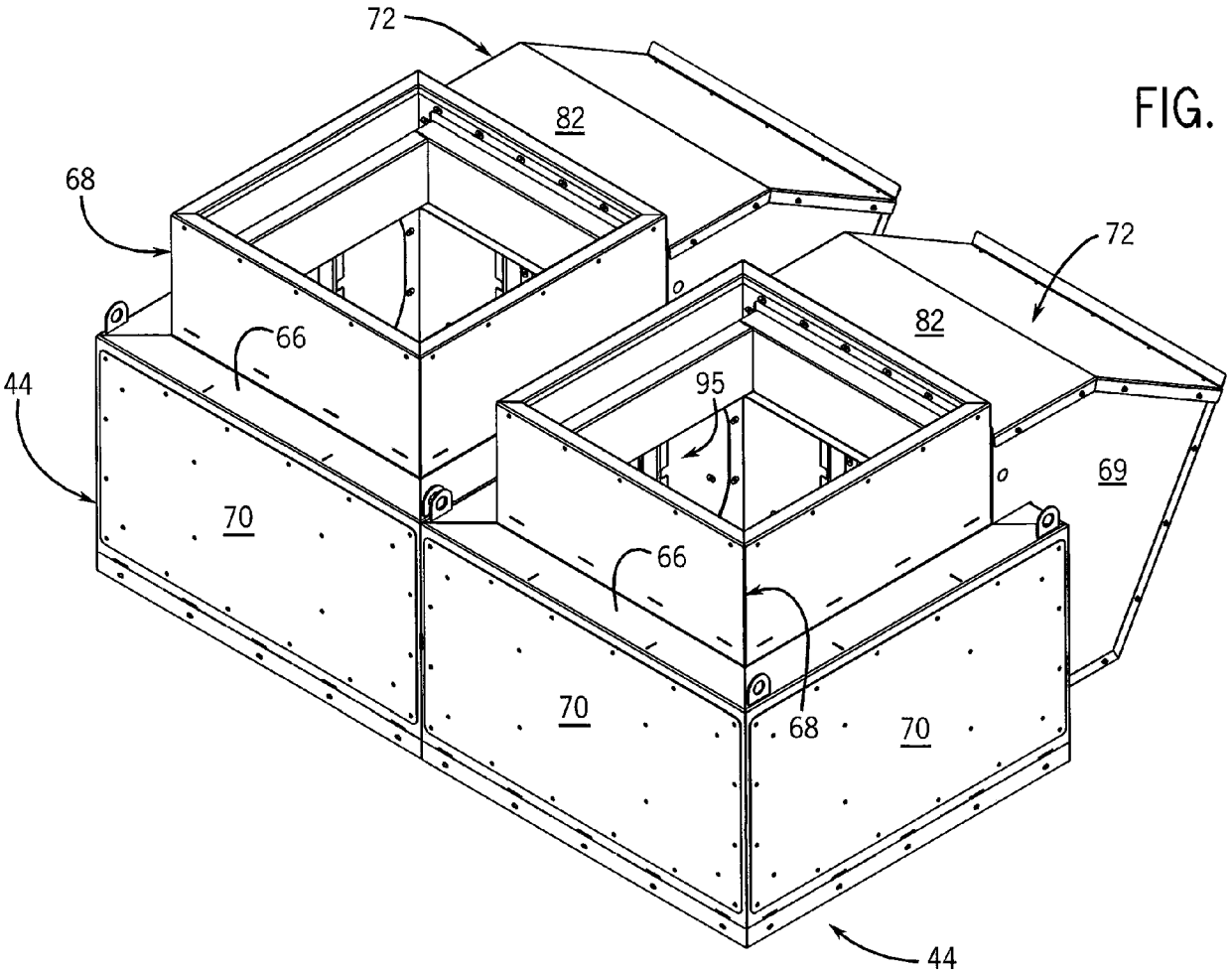
FIG. 4 is a perspective view of two plenums mounted side-by-side.

As shown best in FIG. 4, the removable panels 70 on the sides of the plenum 44 also enable multiple plenums 44 to be combined with a single riser 38. In this configuration the plenums 44 are mounted next to one another and the panels 70 in their abutting walls 64 are removed to form a single, enlarged chamber 95 defined by their combined housings. Any number of plenums 44 may be combined in this manner and complete flexibility in their orientation and the location of their hoods 72 is provided by the same removable panels 70 and mounting holes on all four walls 64 of the plenum 44.

Referring particularly to FIG. 2, the fan assembly 46 is removably mounted on top of the plenum 44. The fan assembly 44 has a rectangular base plate 97 with a downward-extending skirt that fits snuggly around the top edge of the rectangular pedestal 68. Fasteners attach this skirt to the top of the pedestal 68, and by removing these fasteners, the entire fan assembly 46 can be removed for repair or inspection.

The removable panels 70 also enable access to the interior of the plenum 44 from any direction. This enables routine maintenance and repairs to be made without having to remove the entire exhaust fan assembly 42 from the riser 38 or the fan assembly 46 from the plenum 44. Also, in many installations it is advantageous for the building exhaust air to be brought into the plenum 44 through one of its side walls 64 rather than the bottom. In such installations the appropriate panel 70 is removed to form the exhaust inlet to the plenum 44 and the bottom of the plenum housing is enclosed with a bottom wall (not shown in the drawings).

Figure 5:
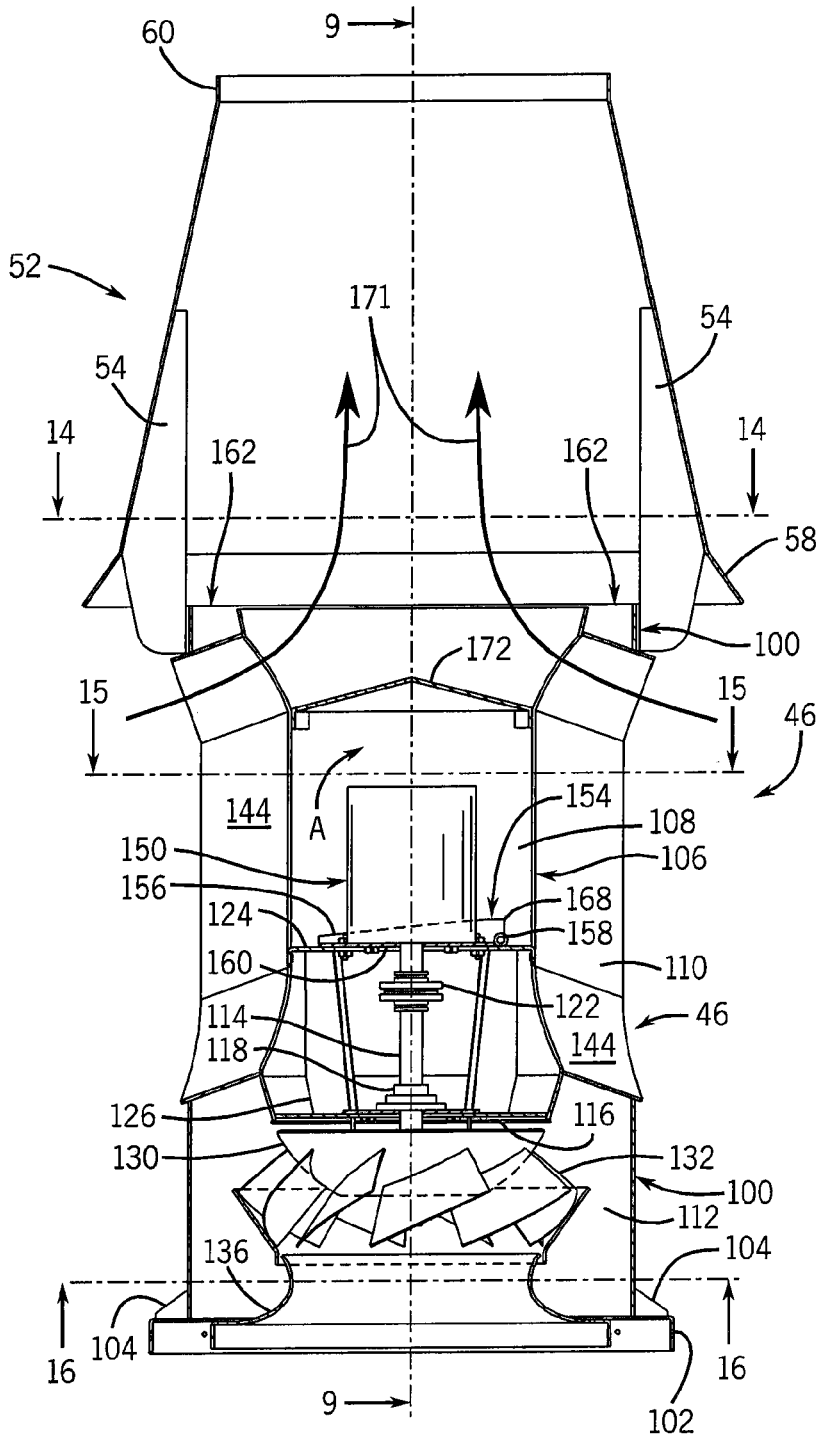
FIG. 5 is a sectional side elevation view of the exhaust assembly illustrated in FIG. 2.
Figure 6:
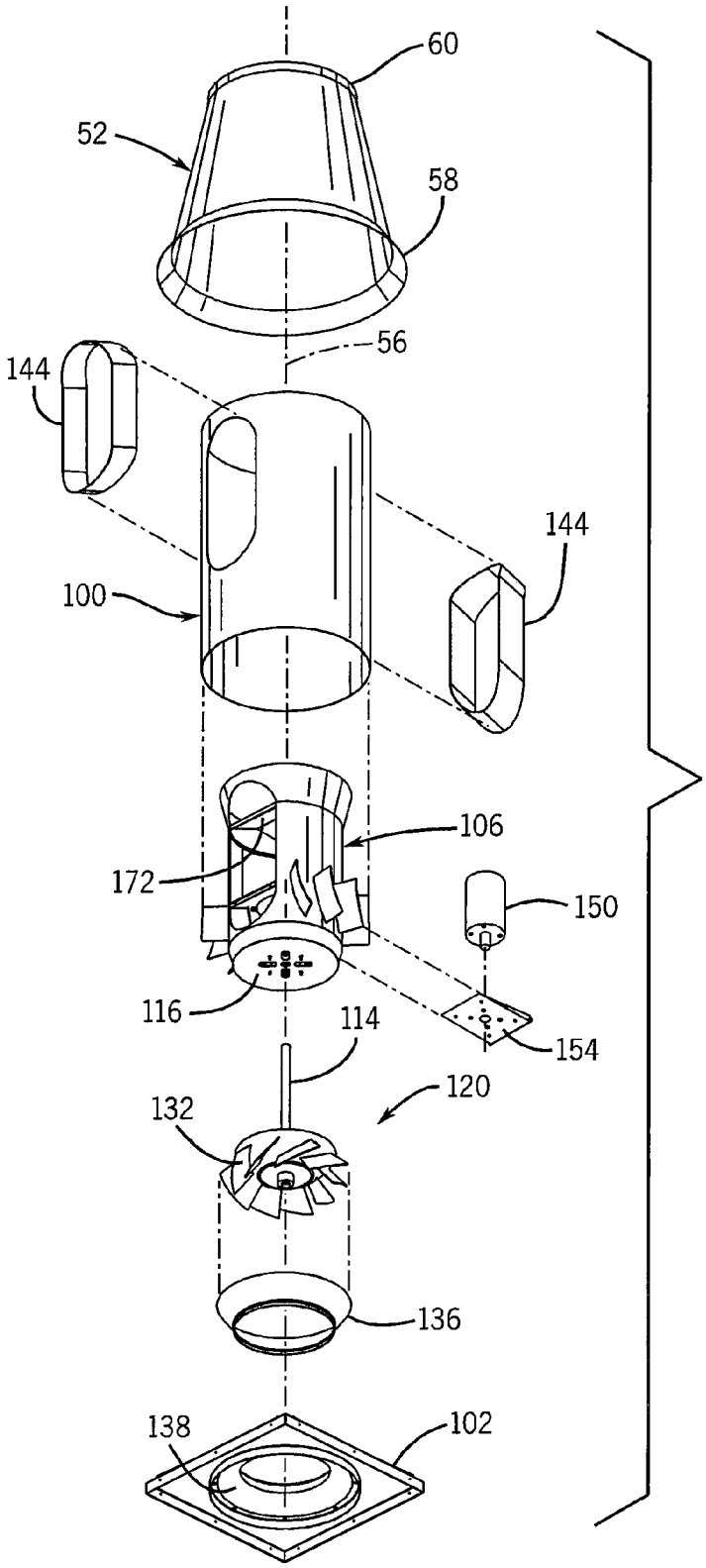
FIG. 6 is an exploded perspective view of the fan assembly of FIG. 5.
Figure 8:
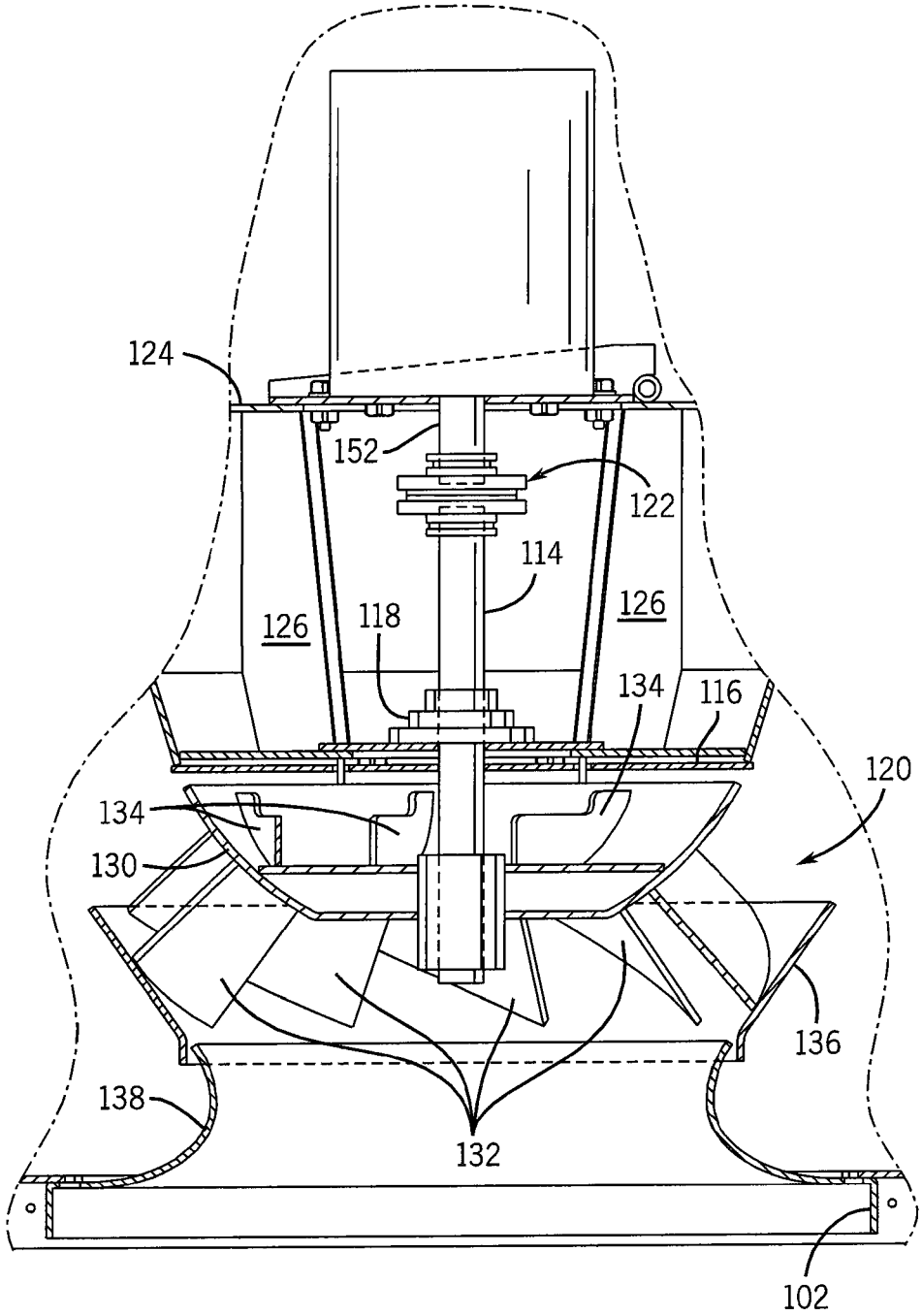
FIG. 8 is a partial view of the fan assembly of FIG. 5 with parts cut away.

Referring to FIGS. 5, 6, and 8, fan assembly 46 sits on top of the plenum 44 and includes a cylindrical outer wall 100 that is welded to a rectangular base plate 102. A set of eight gussets 104 is welded around the lower end of the outer wall 100 to help support it in an upright position. Supported inside the outer wall 100 is a cylindrical shaped inner wall 106 which divides the chamber formed by the outer wall 100 into three parts: a central drive chamber 108, a surrounding annular space 110 located between the inner and outer walls 106 and 100, and a fan chamber 112 located beneath drive chamber 108. The fan chamber 112 and annular space 110 form part of the building exhaust air flow path, while drive chamber 108 is isolated from the flow path and thus is not exposed to contaminants associated with the exhaust air.

A fan shaft 114 is disposed in drive chamber 108 and is rotatably fastened advantageously by a single bearing 118 to a bottom plate 116 that is welded to the bottom end of inner wall 106. Fan shaft 114 extends down into the fan chamber 112 to support a fan wheel 120 at its lower end, and extends up into drive chamber 108 where it is connected to a motor shaft 152 via a compliant flexible coupling 122 that compensates shaft misalignments in at least one, and more preferably two, orientations (e.g., angular and axial shaft misalignments) as described in more detail below. Motor shaft 152 extends through a rectangular horizontal plate 124 that extends across the interior of the drive chamber 108 and is supported from below by a set of gussets 126 spaced around the interior of the drive chamber 108.

As best illustrated in FIG. 8, fan wheel 120 includes a dish-shaped wheelback 130 having a set of main fan blades 132 fastened to its lower surface that support a frustum-shaped rim 136 that extends around the perimeter of the fan blades. The lower edge of this rim 136 fits around a circular-shaped upper lip of an inlet cone 138 that fastens to, and extends upward from the base plate 102. The fan wheel 120 is a mixed flow fan wheel such as that sold commercially by Greenheck Fan Corporation under the trademark MODEL QEI and described in pending U.S. patent application Ser. No. 10/297,450 which is incorporated herein by reference. When the fan wheel 120 is rotated, exhaust air from the plenum 44 is drawn upward through the air inlet formed by the inlet cone 138 and blown radially outward and upward into the annular space 110 as shown by arrows 140 (FIG. 9).

Wheelback 130 can also include, if desired, a set of auxiliary fan blades 134 fastened to its upper surface that produce a radially outward directed air flow. Because shaft 114 and bearing 118 should provide a good seal with the bottom plate 116, no source of air should be available and this air flow is not well defined. However, if a leak should occur, an air flow pattern is established in which air is drawn from the drive chamber 108 and directed radially outward through a gap formed between the upper rim of the fan wheel 130 and the bottom plate 116. As a result, exhaust air cannot escape into the drive chamber 108 even if a leak should occur.

As best illustrated in FIGS. 5 and 6, access to drive chamber 108 from outside the fan assembly 46 is provided by two passageways formed on opposite sides. Each passageway is formed by aligned elongated openings formed through the outer wall 100 and inner wall 106 which are connected by a passage wall 144. The passage wall 144 encircles the passageway and isolates it from the annular space 110 through which it extends. As shown best in FIG. 9 one can look through either of the passageways and see a fan drive motor 150 and its associated components, fan shaft 114, and coupling 122. Maintenance personnel thus have easy access to these elements for inspection and repair.

Figure 7:
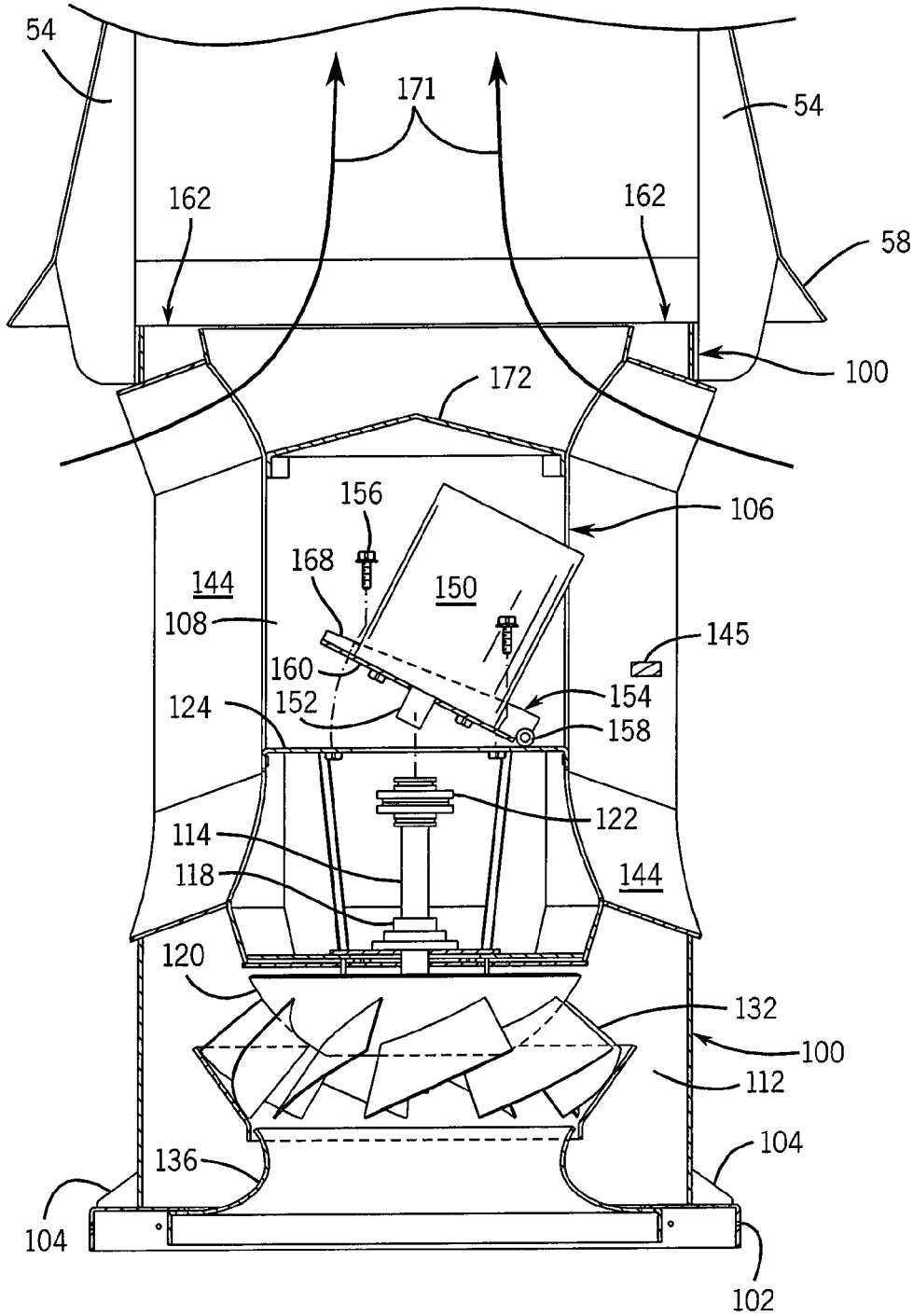
FIG. 7 is an enlarged sectional side elevation view similar to FIG. 5 but illustrating the fan motor in a pivoted position.
Figure 9:
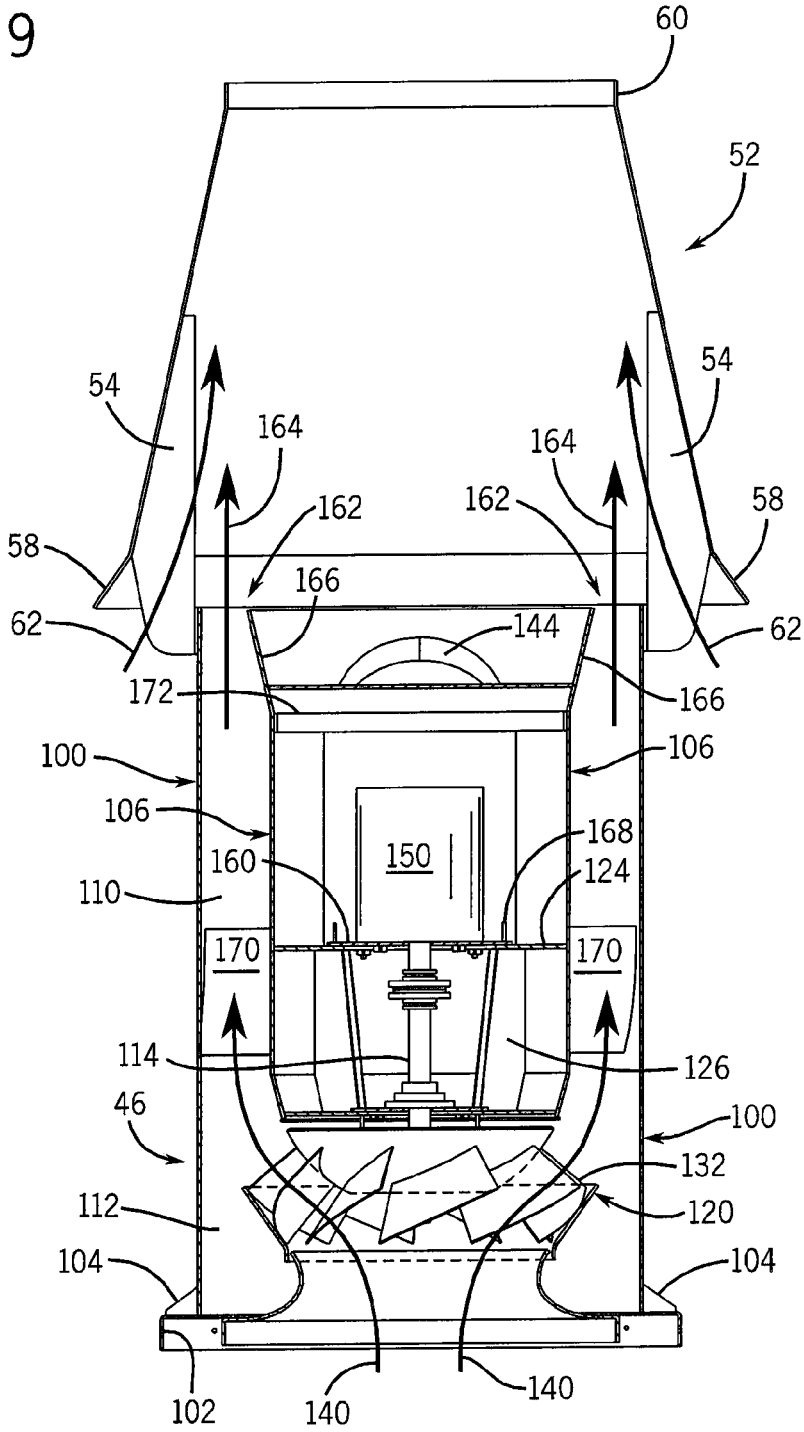
FIG. 9 is a view in cross-section taken along the plane 9-9 shown in FIG. 5.

Referring now to FIGS. 5, 7, and 9, fan drive motor 150 is located in drive chamber 108 and is mounted to a substantially rectangular horizontal support plate 124 that extends between inner wall 106. Specifically, motor 150 is affixed to the upper surface of a mounting bracket 154, which is fastened to the upper surface of plate 124 via bolts 156 or like fasteners in order to provide structural integrity during operation. Mounting bracket 154 includes a flat horizontally extending rectangular plate 160 and a pair of strengthening flanges 168 extending up from opposing outer ends of the plate. Flanges 168 extend in a direction substantially parallel to an axis extending perpendicular between the passageways.

Figure 10:
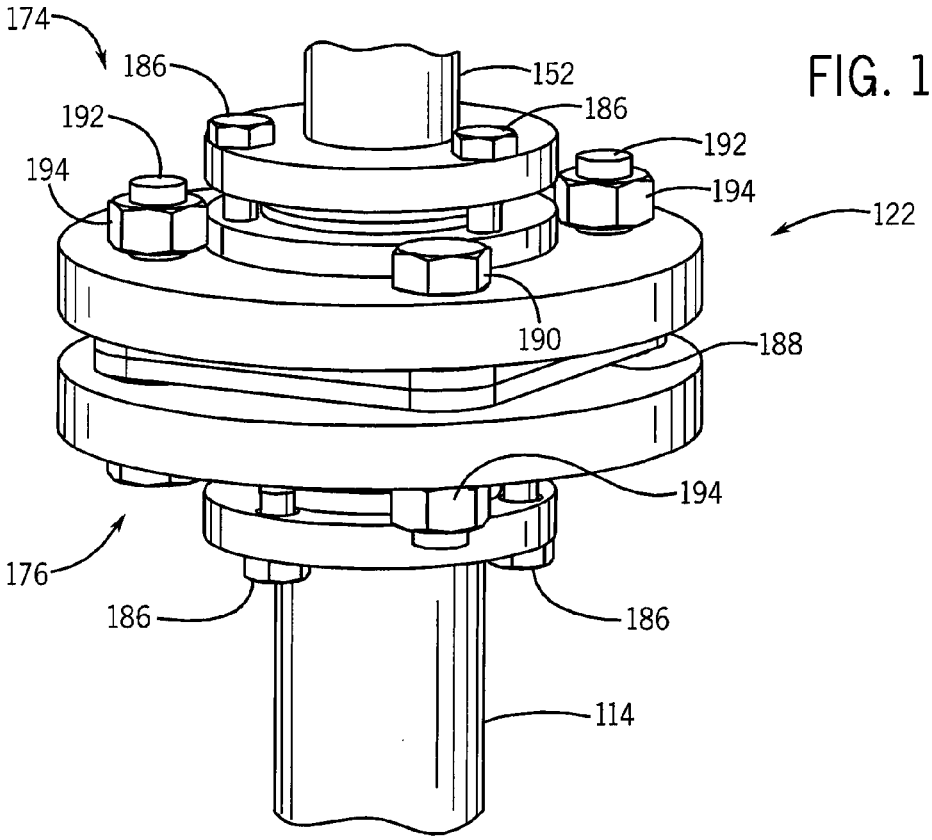
FIG. 10 is a perspective view of the coupling illustrated in FIG. 5.
Figure 11:
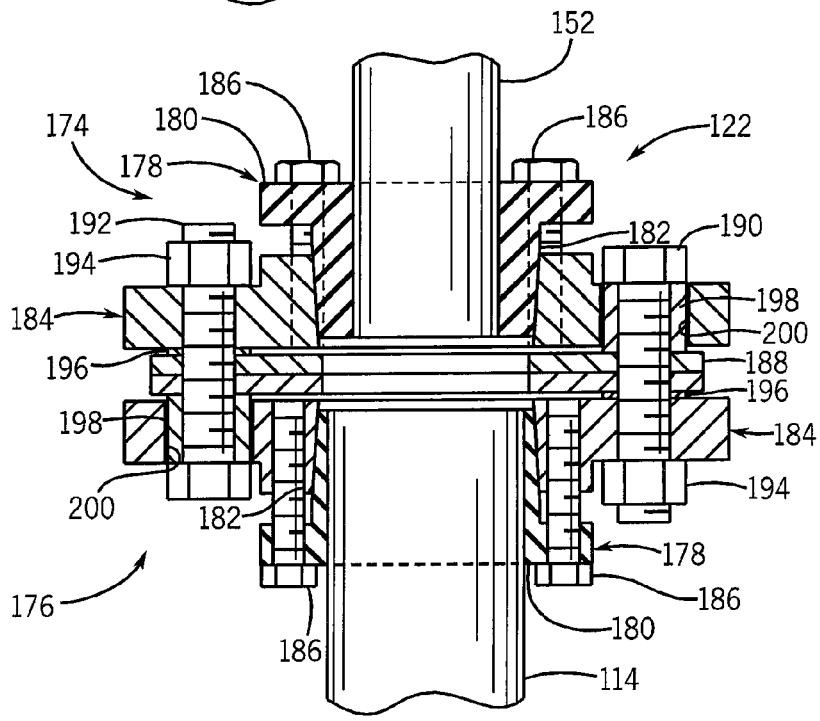
FIG. 11 is a sectional elevation view of the coupling illustrated in FIG. 10.

Referring also to FIGS. 10 and 11, motor shaft 152 extends down through mounting bracket 154, and is connected to the fan shaft 114 via the flexible coupling 122 that enables motor to rotatably drive fan wheel 120 during operation. Coupling 122 can be a Sure-Flex—AR Series 4 Bolt Single Flexing Coupling of the type commercially available from TB Woods, Inc., located in Chambersburg, Pa., and is advantageously both axially and angularly compliant, as will now be described.

Coupling 122 includes an upper segment 174 fastened to the motor shaft 152, and a lower segment 176 fastened to the fan shaft 114. Each segment includes an adapter 178 that surrounds the terminal end of the corresponding shaft. Each adapter 178 includes a radial flange 180 at its axially outer end and a sleeve 182 extending axially inwardly from the flange 180. Each sleeve 182 has a cylindrical inner wall that receives the corresponding shaft, and an outer wall that is sloped radially inwardly along direction taken axially inward from flange 180. Each sleeve 182 is fitted inside a corresponding bushing 184 having an inner cylindrical wall that is sloped to mate with sloped outer wall of sleeve 182. Three screws 186 (two shown) are spaced 120° apart from each other, and extend through flange 180 and into bushing 184. As screws 186 are tightened, the sloped inner walls of bushings 184 biases sleeve 182 against the corresponding shaft, thus locking shafts 152 and 114 in the coupling 122.

It should be appreciated that a number of commercially available couplings provide alternative, yet suitable, mechanisms that fasten a shaft to the coupling (e.g., a set screw). All such alternative designs are intended to fall within the scope of the present invention.

A horizontally extending flexible cylindrical plate 188, which can be made from stainless steel or any suitable alternative material, is disposed between bushings 184. The upper bushing 184 is connected to plate 188 via a pair of upright screws 190 and the lower bushing 184 is connected to plate 188 via a pair of inverted screws 192. Each upright screw 190 is radially spaced 180° with respect to each other, and 90° with respect to each adjacent inverted screw 192 (FIGS. 11 and 12 illustrate an upright screw 190 and an inverted screw 192 radially spaced 180° from each other for the purposes of simplicity, it being appreciated that the upright and inverted screws are actually spaced 90° from each other).

Each upright screw 190 extends downward through upper and lower bushings bushings 184, and is fastened by a conventional nut 194. A washer 196 is disposed between plate 188 and lower bushing 184. An unthreaded sleeve 198 surrounds the shaft of screw 190 proximal to the screw head, and acts against the upper surface of plate 188. Accordingly, sleeve 198 and nut 194 fasten plate 188 to the lower bushing 184. Sleeve 198 extends through a bore 200 formed in upper bushing 184 that has a diameter greater than the diameter of both the sleeve 198 and the screw head to provide clearance that enables both angular displacement of sleeve 198 within bore 200 and axial displacement of the screw head and sleeve 198 within bore 20. The inverted screws 192 similarly extend upward through lower and upper bushings 184 to fasten the upper bushing 184 to plate 188.

Figure 12:
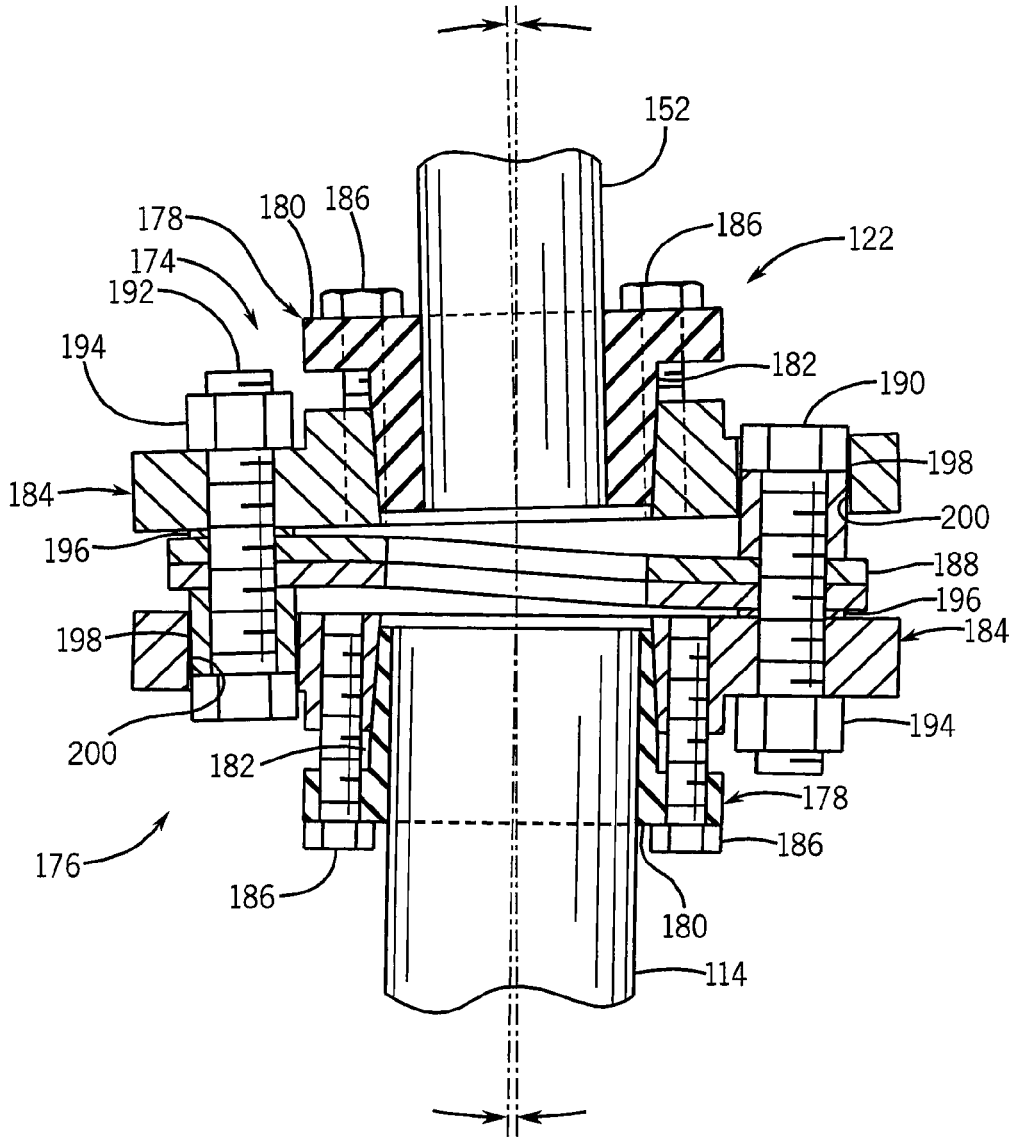
FIG. 12 is a sectional elevation view of the coupling illustrated in FIG. 11, but in a flexed position.

Referring to FIG. 12, coupling 122 is angularly compliant. Specifically, when shafts 114 and 152 are angularly misaligned, the screw heads become angularly misaligned within the corresponding bore 200, and plate 188 flexes to accommodate the angular misalignment. The clearance between sleeves 198 and corresponding bores 200 extending through bushings 184, in combination with flexible plate 188, thus enable coupling 122 to operate even through shafts 112 and 152 are angularly misaligned. In accordance with one embodiment of the present invention, coupling 122 accommodates 1° of angular misalignment between shafts 112 and 152, however the present invention is not to be so narrowly construed.

Coupling 122 is furthermore axially compliant. Specifically, sleeves 182 and 198 are compressible in the axial direction if, for instance, shafts 114 and 152 are pushed toward each other during operation. If, on the other hand, shafts 114 and 152 are pulled in a direction away from each other, upper and lower bushings 184 separate, thus depressing the screw heads of screws 190 and 192 into the corresponding bores 200. Plate 188 also flexes in this situation to accommodate the axial separation of bushings 184.

When maintenance operations are to be performed on motor 150 or its associated components inside drive chamber 108, screws 186 can be accessed via the passageway through annular space 110 and an access opening that exists between rectangular plate 124 and cylindrical inner wall 106. Once screws 186 have been loosened, shaft 152 can be removed from sleeve 182. Advantageously, coupling 122 is disposed in drive chamber 108 and, accordingly, the user is not exposed to the contaminants of the building exhaust when disengaging shaft 152 from the coupling 122. Furthermore, because only single bearing 118 rotatably supports fan shaft 114, maintenance is reduced compared to conventional systems whose fan/motor shafts require at least two bearings. Moreover, bearing 118 absorbs the thrust loads imparted by fan wheel 120, thus preserving the bearings inside motor 150.

Advantageously, one edge of mounting bracket 154 is connected to plate 124 via a hinge 158 that permits mounting bracket 154 to pivot relative to plate 124 once fastener(s) 156 have been removed. Preferably hinge 158 is oriented perpendicular to an axis extending perpendicular between the passageways. In this regard, hinge 158 extends perpendicular to flanges 168. Hinge 158 permits mounting bracket 154 and motor 150 to pivot between a first position in which shafts 152 and 114 can be engaged by coupling 122 and fasteners 156 can connect bracket 154 to plate 124, and towards one of the passageways in the direction of Arrow A to a second position whereby inspection and maintenance can be performed. Wedge-shaped flanges 168 provide additional structural support for bracket at locations proximal hinge 158 where increased forces result from motor pivoting.

Motor 150 can be manually pivoted about hinge 158 at any angle between 0° and 180° (with respect to bracket 154 and plate 124) to provide the needed access to the components inside chamber 18. In one aspect of the invention, motor 150 pivots at an angle of about 90° such that the vertical surfaces of flanges 168 proximal hinge 158 provide a stop with respect to motor 150 pivoting beyond 90°. Alternatively, the vertical flange surfaces could be positioned to provide additional clearance with respect to plate 124, thereby allowing the motor to pivot beyond 90°. In this instance, a stop in the form of flange 145 could extend from wall 144 (FIG. 7) and protrude a desired distance to engage upper surface of bracket once motor 150 has pivoted to the desired angle. Once pivoted, a portion of motor 150 can extend through one of the passageways while access to components inside drive chamber 108 can be achieved via the other passageway.

It should be appreciated that hinge 158 can be disassembled in the usual manner (e.g., by removing the hinge pin) in order to facilitate removal of motor 150 from assembly 42.

Figure 13:
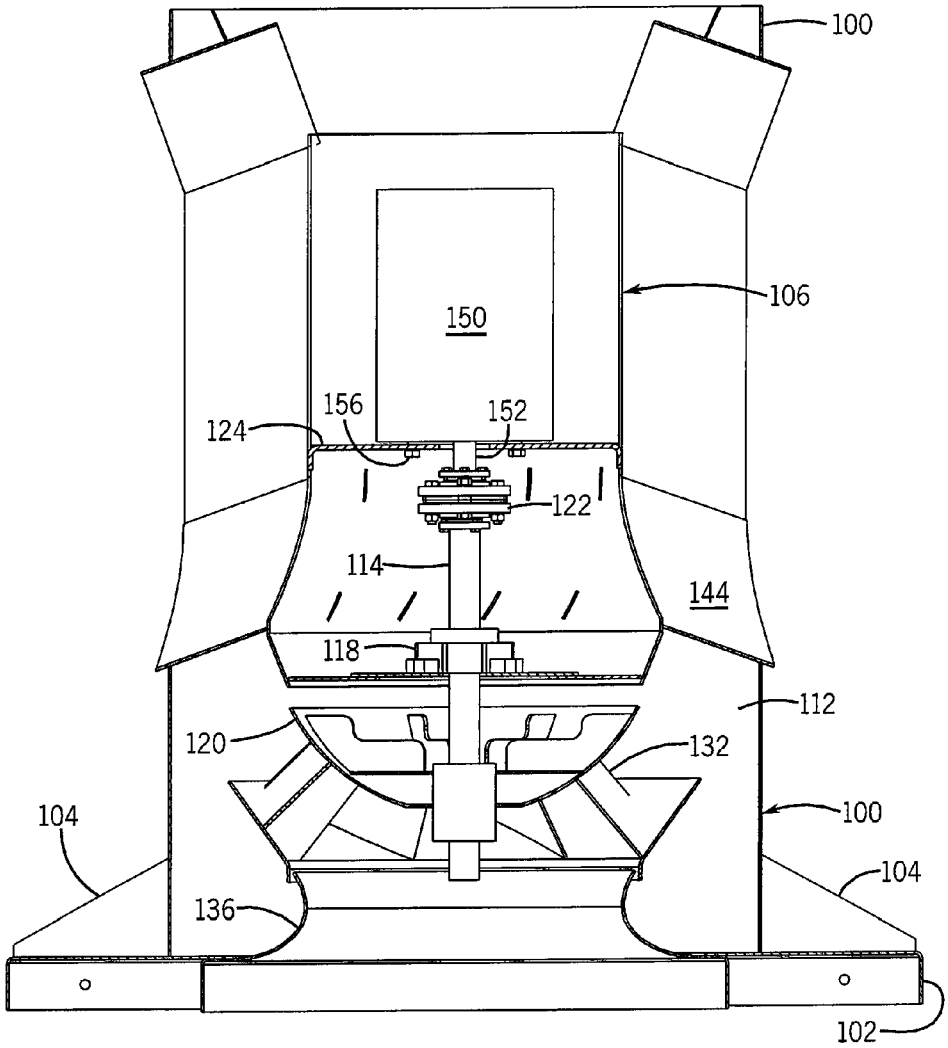
FIG. 13 is a sectional elevation view similar to FIG. 7, but illustrating the motor mounted in accordance with an alternative embodiment.
Figure 14:
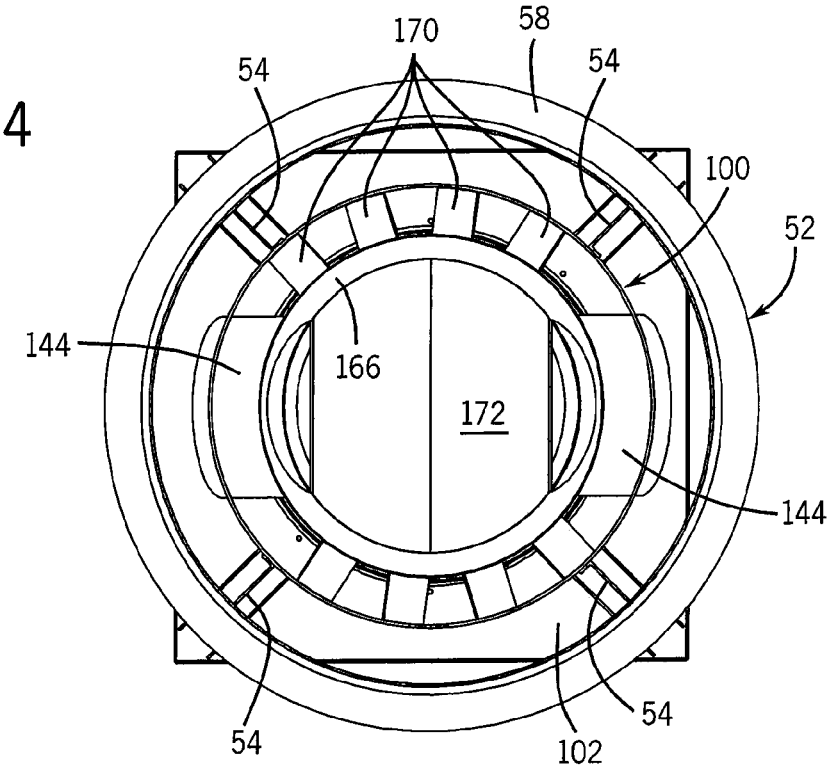
FIG. 14 is a view in cross-section taken along the plane 14-14 shown in FIG. 5.

Alternatively, referring to FIG. 13, motor 150 can be directly fastened to plate 124 via screws 156. In this embodiment, motor shaft 152 can be disengaged from coupling 122 in the manner described above, and screws 156 can be removed from the bottom of motor 150, thus freeing the motor 150 for removal from the drive chamber 108.

Figure 15:
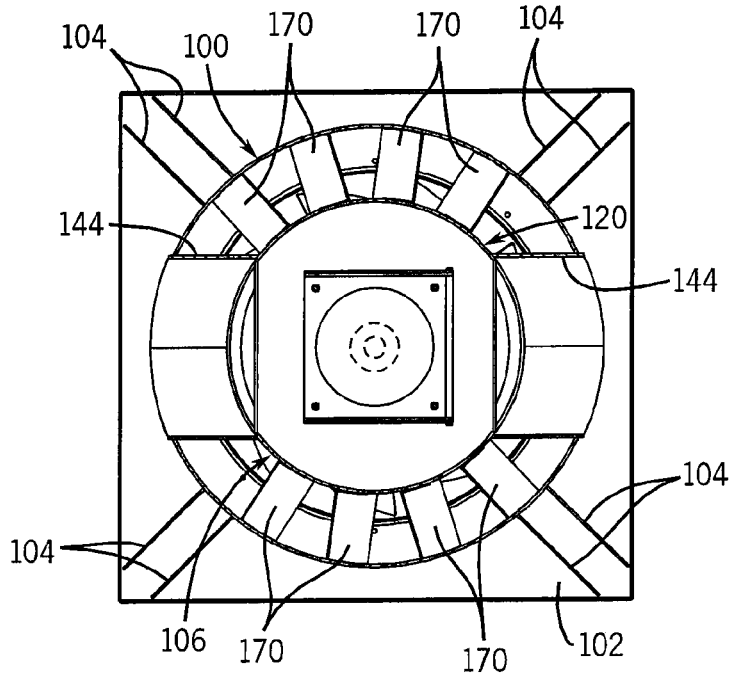
FIG. 15 is a view in cross-section taken along the plane 15-15 shown in FIG. 5.
Figure 16:
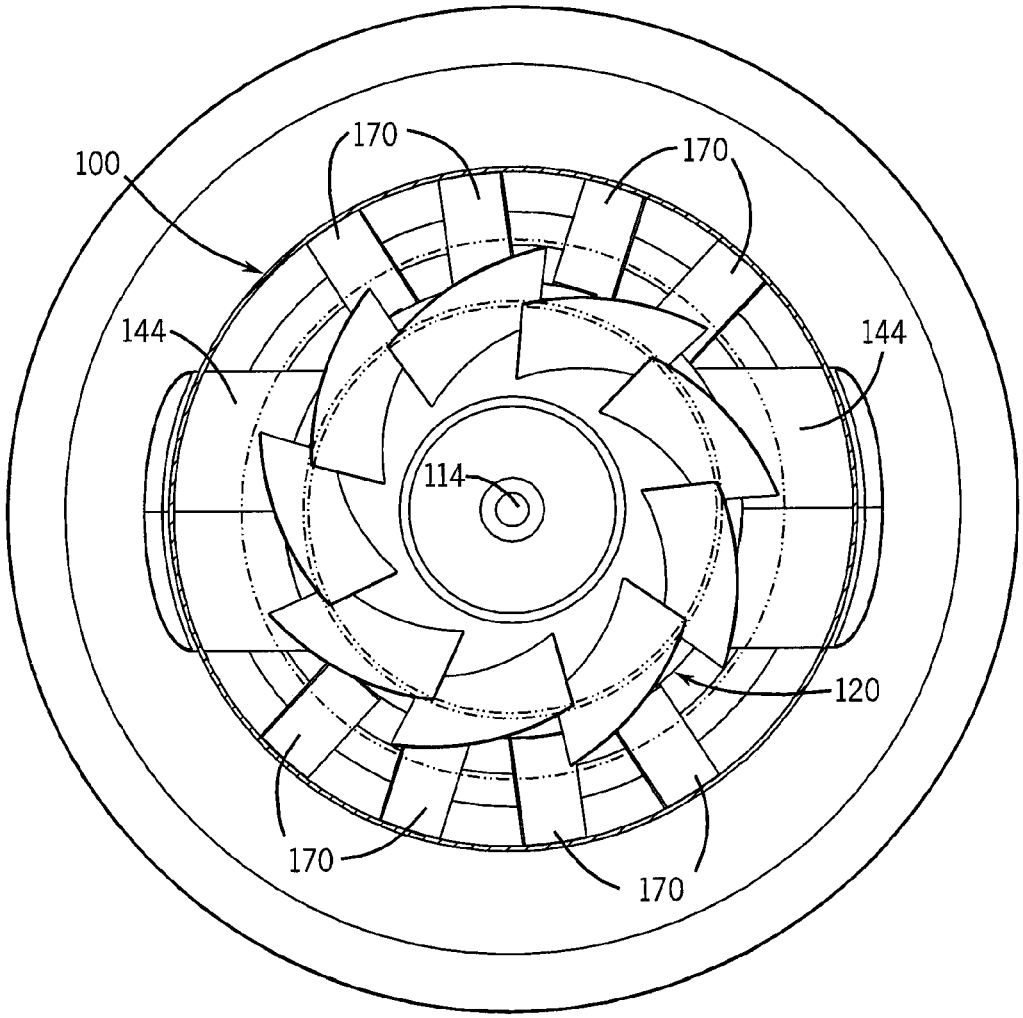
FIG. 16 is a view in cross-section taken along the plane 16-16 shown in FIG. 5.

Referring now to also to FIGS. 5-7 and 9, the exhaust air moves up through the annular space 110 and exits through an annular-shaped nozzle 162 formed at the upper ends of walls 100 and 106 as indicated by arrows 164. The nozzle 162 is formed by flaring the upper end 166 of inner wall 106 such that the cross-sectional area of the nozzle 162 is substantially less than the cross-sectional area of the annular space 110. As a result, exhaust gas velocity is significantly increased as it exits through the nozzle 162. As shown best in FIGS. 9 and 15, vanes 170 are mounted in the annular space 110 around its circumference to straighten the path of the exhaust air as it leaves the fan and travels upward. The action of vanes 170 has been found to increase the entrainment of ambient air into the exhaust as will be described further below.

Referring particularly to FIGS. 6 and 9, a windband 52 is mounted on the top of fan assembly 46 and around nozzle 162. A set of brackets 54 is attached around the perimeter of the outer wall 100. Brackets 54 extend upward and radially outward from the top rim of outer wall 100, and fasten to the windband 52. Windband 52 is essentially frustum-shaped with a large circular bottom opening coaxially aligned with the annular nozzle 162 about a central axis 56. The bottom end of the windband 52 is flared by an inlet bell 58 and the bottom rim of the inlet bell 58 is aligned substantially coplanar with the rim of the nozzle 162. The top end of the windband 52 is terminated by a circular cylindrical ring section 60 that defines the exhaust outlet of the exhaust assembly 42.

Referring particularly to FIG. 9, the windband 52 is dimensioned and positioned relative to the nozzle 162 to entrain a maximum amount of ambient air into the exhaust air exiting the nozzle 162. The ambient air enters through an annular gap formed between the nozzle 162 and the inlet bell 58 as indicated by arrows 62. It mixes with the swirling, high velocity exhaust exiting through nozzle 162, and the mixture is expelled through the exhaust outlet at the top of the windband 52.

A number of features on this system serve to enhance the entrainment of ambient air and improve fan efficiency. The flared inlet bell 58 at the bottom of the windband 52 has been found to increase ambient air entrainment by several percent. This improvement in air entrainment is relatively insensitive to the angle of the flare and to the size of the inlet bell 58. The same is true of the ring section 60 at the top of the windband 52. In addition to any improvement the ring section 60 may provide by increasing the axial height of the windband 52, it has been found to increase ambient air entrainment by 5% to 8%. Testing has shown that minor changes in its length do not significantly alter this performance enhancement.

It has been discovered that ambient air entrainment is maximized by minimizing the overlap between the rim of the nozzle 162 and the bottom rim of the windband 52. In the preferred embodiment these rims are aligned substantially coplanar with each other such that there is no overlap.

Another feature which significantly improves fan system operation is the shape of the nozzle 162. It is common practice in this art to shape the nozzle such that the exhaust is directed radially inward to "focus" along the central axis 56. This can be achieved by tapering the outer wall radially inward or by tapering both the inner and outer walls radially inward to direct the exhaust towards the central axis 56. It is a discovery of the present invention that ambient air entrainment can be increased and pressure losses decreased by shaping the nozzle 162 such that exhaust air is directed radially outward rather than radially inward towards the central axis 56. In the preferred embodiment this is achieved by flaring the top end 166 of the inner wall 106. Air entrainment is increased by several percent and pressure loss can be reduced up to 30% with this structure. It is believed the increase in air entrainment is due to the larger nozzle perimeter that results from not tapering the outer wall 100 radially inward. It is believed that the reduced pressure loss is due to the fact that most of the upward exhaust flow through the annular space 110 is near the outer wall 100 and that by keeping this outer wall 100 straight, less exhaust air is diverted, or changed in direction by the nozzle 162.

Referring particularly to FIG. 5, ambient air is also drawn in through the passageways and mixed with the exhaust air as indicated by arrows 170. This ambient air flows out the open top of the flared inner wall 106 and mixes with the exhaust emanating from the surrounding nozzle 162. The ambient air is thus mixed from the inside of the exhaust.

As shown in FIGS. 5, 6, 9 and 14, to protect the fan drive elements in the drive chamber 108 from the elements, a sloped roof 172 is formed above the top end of the fan shaft 114. The roof 172 seals off the drive chamber 108 from the open top end of the inner wall 106, and it is sloped such that rain will drain out the passageways. The slope of roof 172 also provides additional clearance to enable unobstructed pivoting of motor 150. In another aspect of the invention, roof 172 can be eliminated to more easily facilitate the removal of motor 150 from assembly 42, which can be easily achieved by lifting motor 150 up through windband 52.

Figure 17:
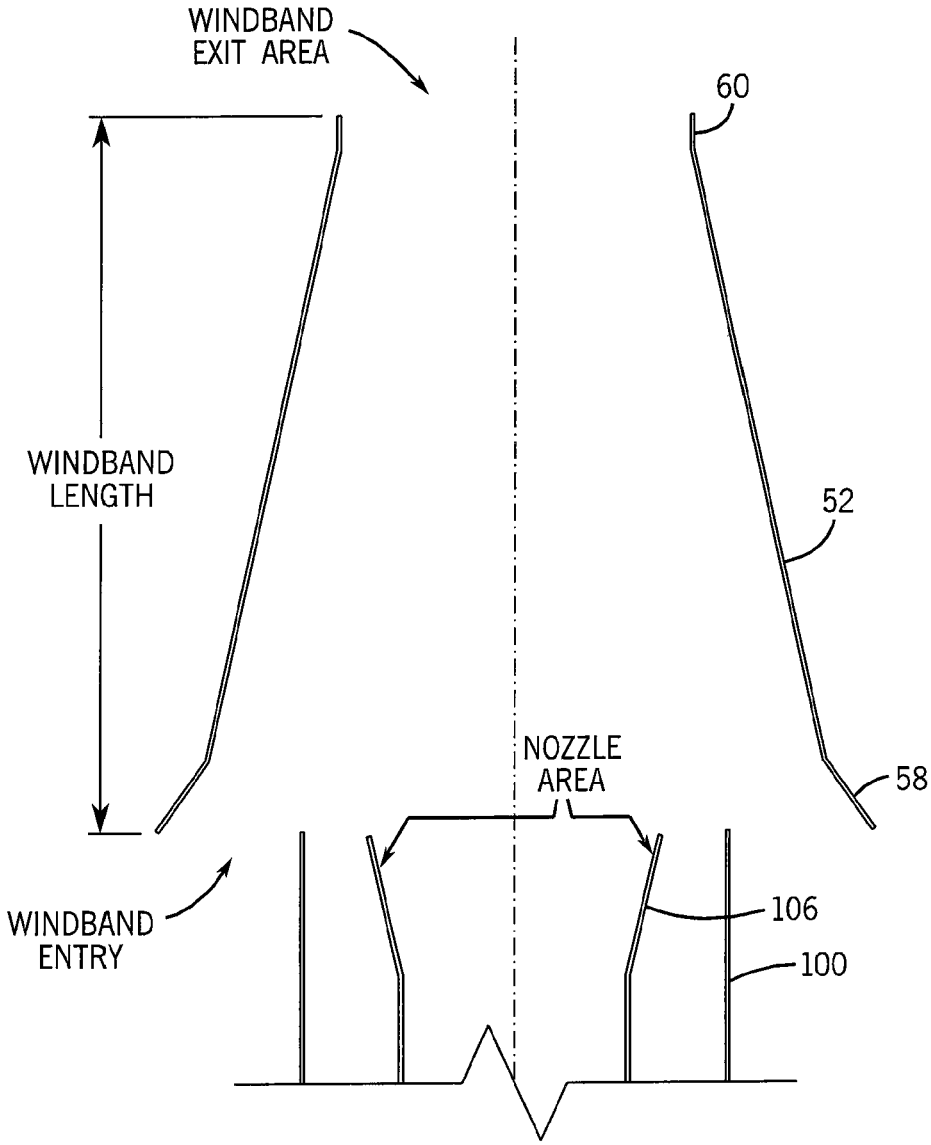
FIG. 17 is a schematic diagram of the fan assembly showing the parameters which determine the desired performance.

In addition to the performance enhancements discussed above, the structure of the exhaust assembly lends itself to customization to meet the specific needs of users. Such user specifications include volume of exhaust air, plume height, amount of dilution with ambient air, and assembly height above roof top. User objectives include minimizing cost. Such customization is achieved by selecting the size, or horsepower, of the fan motor 150, and by changing the four system parameters illustrated in FIG. 17.

Nozzle Exit Area:

Increasing this parameter decreases required motor HP, decreases ambient air entrainment, decreases plume rise. Decreasing this parameter increases required motor HP, increases ambient air entrainment, increases plume rise.

Windband Exit Area:

Increasing this parameter increases ambient air entrainment, does not significantly affect plume rise or fan flow. Decreasing this parameter decreases ambient air entrainment, does not significantly affect plume rise or fan flow.

Windband Length:

Increasing this parameter increases ambient air entrainment, increases plume rise, does not affect fan flow. Decreasing this parameter decreases ambient air entrainment, decreases plume rise, does not affect fan flow.

Windband Entry Area (minor effect)

Increasing this parameter increases ambient air entrainment, increases plume rise, does not affect fan flow. Decreasing this parameter decreases ambient air entrainment, decreases plume rise, does not affect fan flow.

For example, for a specified system, Table 1 illustrates how windband length changes the amount of entrained ambient air in the exhaust and Table 2 illustrates how windband exit diameter changes the amount of ambient air entrainment.

TABLE 1

| Windband Length | Dilution |
|---|---|
| 39 inch | 176% |
| 49 inch | 184% |
| 59 inch | 190% |

TABLE 2

| Windband Exit Diameter | Dilution |
|---|---|
| 17 inch | 165% |
| 21 inch | 220% |
| 25 inch | 275% |

Table 3 illustrates how the amount of entrained ambient and changes as a function of nozzle exit area and Table 4 illustrates the relationship between the amount of entrained ambient air and windband entry area.

TABLE 3

| Nozzle Exit Area | Dilution |
|---|---|
| .79 $ft^2$ | 120% |
| .52 $ft^2$ | 140% |
| .43 $ft^2$ | 165% |

TABLE 4

| Windband Entry Area | Dilution |
|---|---|
| 10.3 $ft^2$ | 176% |
| 12.9 $ft^2$ | 178% |

In Tables 1-4 the dilution is calculated by dividing the windband exit flow by the flow through the fan assembly.

Figure 18:
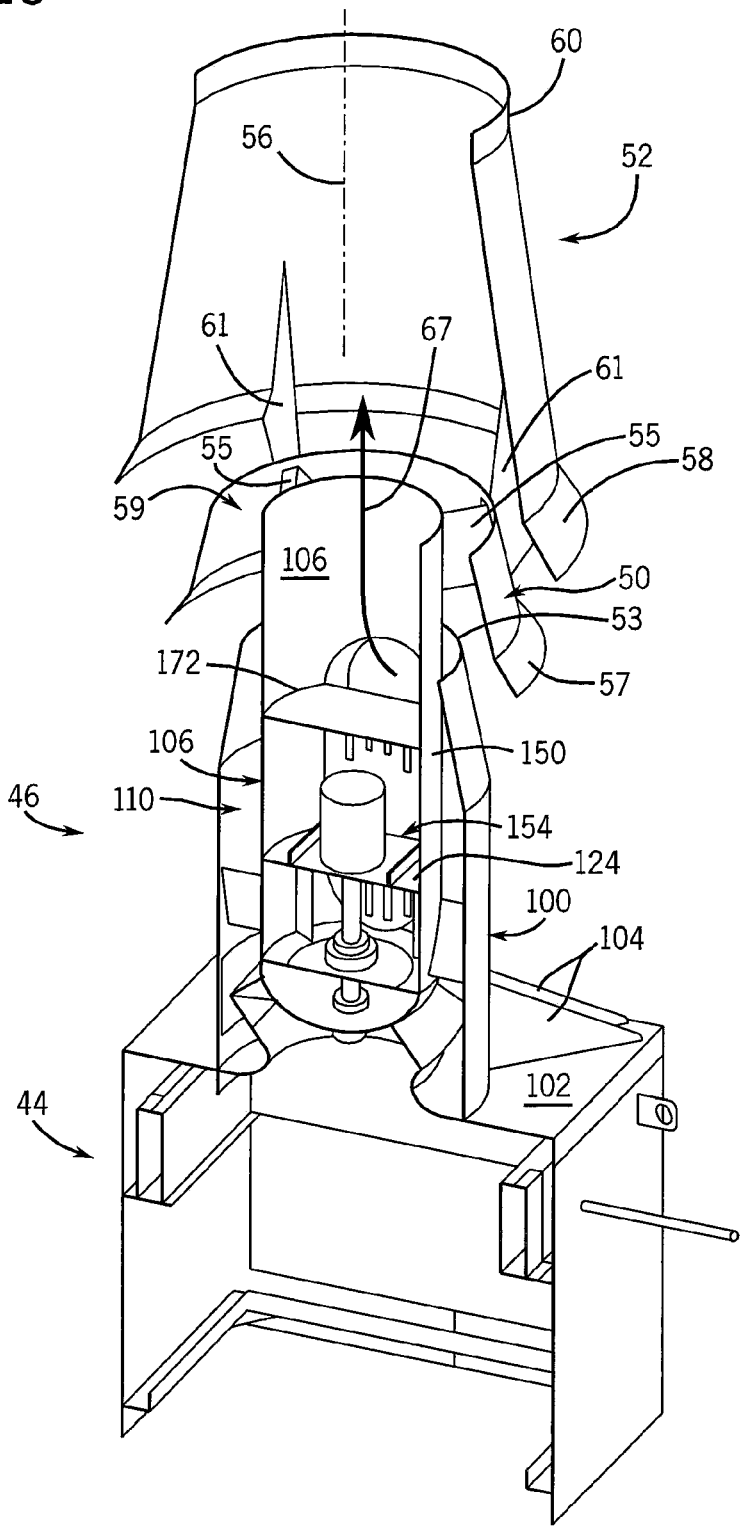
FIG. 18 is a pictorial view with parts cut away of a second embodiment of the exhaust assembly of the present invention.
Figure 19:
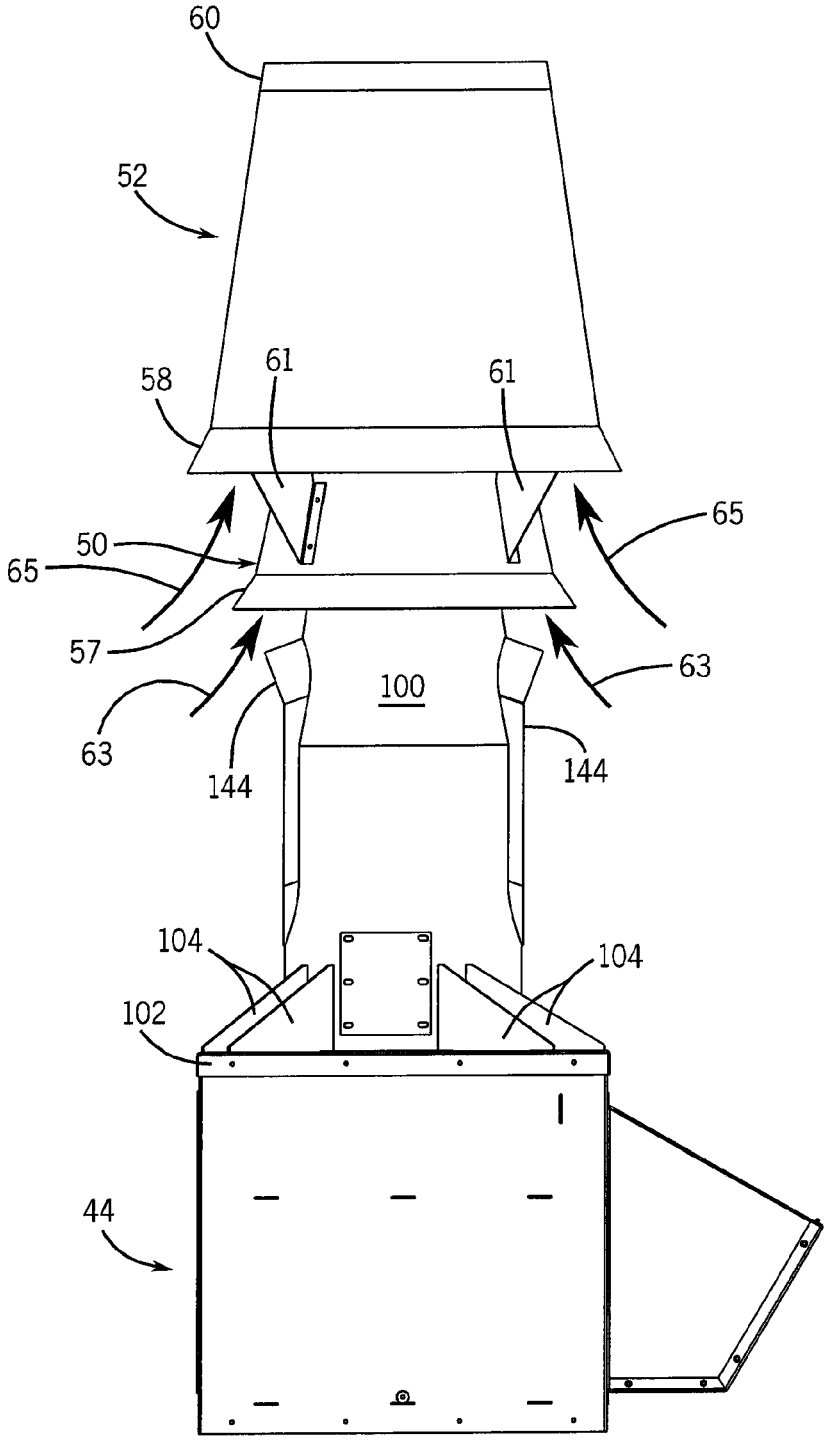
FIG. 19 is an elevation view of the exhaust assembly of FIG. 18.

Referring particularly to FIGS. 18 and 19, an alternative embodiment of the invention is substantially the same as the preferred embodiment described above except the nozzle end of the fan assembly 46 is modified to add an additional, second nozzle assembly 50. In this second embodiment the outer wall 100 of the fan assembly is tapered radially inward at its upper end to form a first nozzle 53 with the inner wall 106 which extends straight upward, beyond the nozzle 53. The second nozzle assembly 50 is a frustum-shaped element which is fastened to the extended portion of the inner wall 106 by brackets 55. It is flared around its bottom end to form an inlet bell 57 similar to that on the windband 52. The second nozzle assembly 50 is concentric about the inner wall 106, and its top end is coplanar with the top end of the inner wall 106 to form an annular-shaped second nozzle 59 therebetween. Brackets 61 fasten around the perimeter of the second nozzle assembly 50 and extend upward and radially outward to support the windband 52. The windband 52 is also aligned coaxial with the inner wall 106 and second nozzle assembly 50 and its lower end is substantially coplanar with the top end of the second nozzle 59. In this alternative embodiment it is also possible to form the first nozzle 53 by flaring the inner wall 106 outward rather than tapering the outer wall 100.

Referring particularly to FIG. 19, the annular space between the lower end of the second nozzle assembly 50 and the outer wall 100 forms a first gap through which ambient air enters as indicated by arrows 63. This air is entrained with the swirling exhaust air exiting the first nozzle 53 to dilute it. Similarly, the annular space between the lower end of the windband 52 and the second nozzle assembly 50 forms a second gap through which ambient air enters as indicated by arrows 65. This air is entrained with the once diluted exhaust air exiting the second nozzle 59 to further dilute the exhaust. As with the first embodiment, further ambient air which enters through the passageways and flows out the top end of the inner wall 106 as shown in FIG. 18 by arrow 67 also dilutes the exhaust before it is expelled at high velocity out the exhaust outlet at the top of the windband 52.

The above description has been that of the preferred embodiment of the present invention, and it will occur to those having ordinary skill in the art that many modifications may be made without departing from the spirit and scope of the invention. In order to apprise the public of the various embodiments that may fall in the scope of the present invention, the following claims are made.

The invention claimed is:

1. A fan assembly configured to exhaust contaminated air from a building, the fan assembly comprising:

an outer fan body having open top and bottom ends and defining a cavity therebetween extending from an air inlet formed at the bottom end to an air outlet at the top end, the air inlet and the air outlet receiving the contaminated air;

an inner fan body fastened to the outer fan body and positioned in the cavity to divide it into a central chamber isolated from the contaminated air, and a surrounding annular space for communicating the contaminated air from the air inlet to the air outlet;

a fan disposed in the cavity and coupled to a fan shaft to draw exhaust air in through the air inlet and blow it upward through the annular space to the air outlet;

a motor mounted in the central chamber, the motor having a motor shaft that drives the fan shaft; and a coupling located in the central chamber connecting the fan shaft to the motor shaft, wherein the coupling is compliant with respect to misalignment between the motor shaft and the fan shaft in at least one orientation;

wherein the motor is pivotally mounted in the central chamber to be pivotable between a first engaged position in which the shaft is coupled to the fan shaft via the coupling and a second disengaged pivoted position in which the motor shaft is uncoupled from the fan shaft.

2. The fan assembly as recited in claim 1 in which the coupling is compliant with respect to axial misalignment between the motor shaft and the fan shaft.

3. The fan assembly as recited in claim 1 in which the coupling is compliant with respect to angular misalignment between the motor shaft and the fan shaft.

4. The fan assembly as recited in claim 1, further comprising a plate extending through the central chamber to separate a fan chamber housing the fan from a drive chamber housing the motor.

5. The fan assembly as recited in claim 4 in which the combination of the fan shaft and motor shaft is supported by a single bearing supported by the plate.

6. The fan assembly as recited in claim 1 in which the motor is mounted to a plate that defines an access opening between the plate and the inner fan body, the opening providing access to the coupling.

7. The fan assembly as recited in claim 6 in which the motor is fastened to the plate by at least one removable fastener.

8. A fan assembly mounted onto a roof of a building for removing contaminated air from one or more building exhaust vents, the fan assembly comprising:

an open-ended fan body defining an air inlet receiving the contaminated air, at least one ambient air entrainment zone mixing ambient air with the contaminated air to produce diluted air, and an air outlet exhausting the diluted air, the fan body also defining an interior drive chamber isolated from the exhaust air and an annular cavity between the air inlet and the air outlet;

a fan disposed in the fan body and coupled to a fan shaft to draw exhaust air in through the air inlet and blow it in a direction toward the air outlet;

a motor disposed in the drive chamber and having a motor shaft operable to drive the fan shaft; and a coupling connecting the fan shaft to the motor shaft in which the coupling is compliant with respect to misalignment between the motor shaft and the fan shaft in at least one orientation;

wherein the motor is pivotally mounted in the drive chamber to be pivotable between a first engaged position in which the motor shaft is coupled to the fan shaft via the coupling and a second disengaged pivoted position in which the motor shaft is uncoupled from the fan shaft.

9. The fan assembly as recited in claim 8 in which the coupling is compliant with respect to axial misalignment between the motor shaft and the fan shaft.

10. The fan assembly as recited in claim 8 in which the coupling is compliant with respect to angular misalignment between the motor shaft and the fan shaft.

11. The fan assembly as recited in claim 8 in which the combination of the fan shaft and motor shaft is supported by a single bearing supported by a plate.

12. The fan assembly as recited in claim 8 in which the motor is mounted to a plate supported in the drive chamber that defines an access opening to the coupling.

13. A fan assembly for expelling exhaust air from a building, the fan assembly comprising:

a fan body defining an open an inlet end receiving the exhaust air and an open air outlet end for expelling the exhaust air, the fan body defining a fan chamber exposed to the exhaust air and an annular cavity for communicating the exhaust air from the air inlet to the air outlet;

a fan disposed in the fan chamber and coupled to a fan shaft for rotation to draw the exhaust air through the inlet and direct the exhaust air from the air inlet to the air outlet via the annular cavity;

a motor mounted inside the fan body having a motor shaft; and at least one passageway extending through the fan body, the passageway providing access to the motor and the coupling;

wherein the motor is pivotally mounted to be pivotable between a first engaged position in which the motor shaft is coupled to the fan shaft via a coupling that is compliant with respect to misalignment between the motor shaft and the fan shaft in at least one orientation and a second disengaged pivoted position in which the motor shaft is uncoupled from the fan shaft.

14. The fan assembly as recited in claim 13 in which the coupling is compliant with respect to axial misalignment between the motor shaft and the fan shaft.

15. The fan assembly as recited in claim 13 in which the coupling is compliant with respect to angular misalignment between the motor shaft and the fan shaft.

16. The fan assembly as recited in claim 13, further comprising a divider separating the fan chamber from a drive chamber of the fan body.

17. The fan assembly as recited in claim 13 in which the combination of the fan shaft and motor shaft is supported by a single bearing supported by the divider.

18. The fan assembly as recited in claim 13 in which the motor is mounted to a plate supported in a drive chamber of the fan body that defines an access opening between the plate and the inner wall.

19. The fan assembly as recited in claim 13 in which the coupling is accessible through the passageway and the access opening.

20. The fan assembly as recited in claim 19 in which the motor is fastened to the plate by at least one removable fastener.

* * * * *